US008602081B2

(12) United States Patent
Komatsu et al.

(10) Patent No.: US 8,602,081 B2
(45) Date of Patent: Dec. 10, 2013

(54) SHEET SHUTTER

(75) Inventors: Akio Komatsu, Shimane (JP); Hitoyuki Adachi, Shimane (JP); Yoshiaki Horie, Shimane (JP); Takeshi Fujii, Shimane (JP)

(73) Assignee: Komatsu Electric Industru Co., Ltd., Shimane (JP)

( * ) Notice: Subject to any disclaimer, the term of this patent is extended or adjusted under 35 U.S.C. 154(b) by 79 days.

(21) Appl. No.: 13/275,364

(22) Filed: Oct. 18, 2011

(65) Prior Publication Data

US 2012/0255683 A1 Oct. 11, 2012

(30) Foreign Application Priority Data

Apr. 6, 2011 (JP) ..... 2011-084627
Apr. 18, 2011 (JP) ..... 2011-092274

(51) Int. Cl.
*E06B 9/13* (2006.01)

(52) U.S. Cl.
USPC ..... 160/273.1; 160/310

(58) Field of Classification Search
USPC ..... 160/273.1, 271, 272, 84.06, 310
See application file for complete search history.

(56) References Cited

U.S. PATENT DOCUMENTS 4,408,650 A * 10/1983 Verch ..... 160/121.1
4,610,293 A * 9/1986 Weiblen ..... 160/120
4,649,981 A * 3/1987 Bibeau ..... 160/120
4,884,617 A * 12/1989 Coenraets ..... 160/271
5,526,865 A * 6/1996 Coenraets ..... 160/272
6,119,758 A * 9/2000 Coenraets ..... 160/273.1
7,036,549 B2 * 5/2006 Coenraets ..... 160/271
7,389,807 B2 * 6/2008 Nagare et al. ..... 160/273.1
7,416,014 B2 * 8/2008 Coenraets ..... 160/273.1
7,665,506 B2 * 2/2010 Coenraets ..... 160/266
7,748,431 B2 * 7/2010 Jansen et al. ..... 160/268.1
7,793,702 B2 * 9/2010 Biewer et al. ..... 160/370.22
7,841,377 B2 * 11/2010 Coenraets ..... 160/268.1

FOREIGN PATENT DOCUMENTS

JP 6-31502 B2 4/1994

* cited by examiner

*Primary Examiner* — David Purol
(74) *Attorney, Agent, or Firm* — Cheng Law Group, PLLC

(57) ABSTRACT

To provide a sheet shutter in which an urging member for urging an unwound, sheet toward the left and right outer side is provided so that the sheet is made to smoothly slide in the left and right direction and the wear of the urging member is suppressed. The sheet shutter according to the present invention is configured such that a rail groove is provided in each of left and right support posts, such that an inner rail is accommodated and supported in the rail grooves, such that engagement guides for guiding the lifting and lowering of the sheet formed in the inner rails, and such that, when the urging member is provided in the rail groove, an elastic sheet section for partitioning the inside of the rail groove into front and rear portions is provided at the urging member.

22 Claims, 13 Drawing Sheets

SHEET SHUTTER

BACKGROUND OF THE INVENTION

1. Field of the Invention

The present invention relates to a sheet shutter which can be installed in an entrance and a partition portion of a building, such as a factory and a warehouse, and which can be installed in various apparatuses.

2. Description of the Related Art

Conventionally, a sheet shutter is widely known which is installed in an entrance and a partition portion of a building, such as a factory or a warehouse, and in which a sheet provided to be able to be wound and unwound around a sheet drum is lifted and lowered along support posts provided on both sides of the sheet. In such a sheet shutter, there is known a sheet shutter in which a vertically directed rail groove whose left and right inner side is opened is formed in an outer rail formed in each of left and right support posts, in which an inner rail is provided in the rail groove, and an engagement guide engaging with each of left and right end portions of a sheet in a vertically slidable and guidable manner and in a laterally movable manner is formed in the inner rail, and in which an urging member for elastically urging the inner rail toward the left and right outer side is provided between the groove side surface that is one of the front and rear surfaces in the rail groove, and the inner rail, so as to stretch the sheet while elastically pulling the inner rail in the outer direction (see, for example, Japanese Patent Publication No. 6-31502).

In the sheet shutter described in Japanese Patent Publication No. 6-31502, when the sheet receives a strong wind or when a person or an object collides with the sheet, the left and right end portion of the sheet can be effectively prevented from coming off from the engagement guide, because the inner rail is operated to be moved toward the left and right inner side against the elastic force of the urging member so as to reduce the shock caused by the wind or the collision.

However, since the urging member formed by a rectangular parallelepiped block-shaped elastic member is inserted in a filled state between the groove side surface and the inner rail, there is a case where, when the inner rail is moved in the left and right direction, the urging member is compressed and deformed so as to be strongly brought into contact with the groove side surface, and thereby a large frictional resistance is generated so as to prevent the inner rail from being smoothly moved in the left and right direction.

Further, the above-described urging member is generally manufactured by processing a sponge made of rubber or a synthetic resin material into a block shape, and has a disadvantage that it wears due to the reciprocating movement, and that, because of its poor weather resistance, it is deteriorated at an early stage so as to lose the elasticity for stretching the sheet. Further, there is a problem that, when the urging member becomes brittle, a small fragment broken off from the urging member enters the gap between the side wall and the rail base so as to reduce the mobility of the inner rail.

A sheet shutter according to the present invention is configured such that an outer rail having a rail groove is provided in each of left and right support posts, such that an inner rail is accommodated and supported in each of the pair of left and right rail grooves so as to be movable in the left and right direction, such that an engagement guide for vertically movably guiding each of left and right end sides of an unwound sheet is provided in each of the left and right inner rails, and such that an urging member which urges the engagement guide toward the left and right outer side to prevent the sheet from slackening is provided in each of the rail grooves. An object of the present invention is to allow the engagement guide to be smoothly moved in the left and right direction and also to suppress the wear of the urging member.

SUMMARY OF THE INVENTION

To this end, firstly, a sheet shutter according to the present invention includes a pair of left and right vertically directed support posts 3 and 3, and a sheet case 4 provided between the upper end portions of the left and right support posts 3 and 3, and is configured such that an outer rail 14 having a vertically directed rail groove 14*c* opened on the left and right inner side in sectional plan view is provided in each of the mutually facing surfaces of the left and right support posts 3 and 3, such that at least a part of an inner rail 16 is accommodated in the rail groove 14*c* of each of the left and right outer rails 14 so as to be left and right movably supported, such that a vertically directed engagement guide 21, which guides the lifting and lowering of each of the left and right end sides of a sheet 2 unwound from the inside of the sheet case 4 in the state where both the left and right end sides of the sheet 2 are regulated from being moved in the left and right direction, is formed in each of the left and right inner rails 16, such that an urging member 26 that elastically urges the inner rail 16 toward the bottom side of the rail groove 14*c* is provided in a gap space 14*e* formed between the inner rail 16 and the groove side surface that is each or one of the front and rear surfaces of the rail groove 14*c* in which the inner rail 16 is accommodated, and such that the sheet 3 is pulled toward both the left and right sides by the urging members 26. The sheet shutter according to the present invention is featured in that the urging member 26 includes an elastic sheet section 29 which partitions the gap space 14*e* into front and rear portions, and in that the inner rail 16 is elastically urged toward the left and right outer side by an elastic curving deformation or an elastic bending deformation of the elastic sheet section 29.

Secondly, the sheet shutter according to the present invention is featured in that a front-rear directed rail base 19 is integrally extended from the bottom surface side end portion of the rail groove 14*c* of the inner rail 16 toward the groove side surfaces, in that an opposite wall 14*d* extended in the front and rear direction from each of the open end sides of the rail groove 14*c* of the outer rail 14 is integrally provided so as to face the rail base 19, and in that the elastic sheet section 29 is inserted between the rail base 19 and the opposite wall 14*d*.

Thirdly, the sheet shutter according to the present invention is featured in that a guide corner section 19*a* is formed by the rail base 19 and the engagement guide 21 extended from the rail base 19 toward the left and right inner side, and also a groove corner section 14*f* is formed by the opposite wall 14*d* and the groove side surface, and in that the elastic sheet section 29 is provided in the gap space 14*e* by being brought into contact with the guide corner section 19*a* and the groove corner section 14*f*.

Fourthly, the sheet shutter according to the present invention is featured in that a plate-shaped opening side contact section 27 which is brought into surface contact with the opposite wall 14*d* is integrally formed at an end portion of the elastic sheet section 29 near the groove corner section 14*f*.

Fifthly, the sheet shutter according to the present invention is featured in that the opening side contact section 27 is formed so as to close the gap space 14*e* on the open end side of the rail groove 14*c*.

Sixthly, the sheet shutter according to the present invention is featured in that the end portion of the elastic sheet section 29 on the side of the rail base 19 is formed integrally with the rail base 19.

Seventhly, the sheet shutter according to the present invention is featured in that a plate-shaped bottom side contact section 28 which is brought into surface contact with the rail base 19 is integrally formed at an end portion of the elastic sheet section 29 on the side of the guide corner section 19*a*.

Eighthly, the sheet shutter according to the present invention is featured in that an expanding/contracting section which is formed in a bellows shape by a plurality of foldable bending section 29*a* is provided in the elastic sheet section 29.

Ninthly, the sheet shutter according to the present invention is featured in that the outer rail 14 is formed integrally with an inner wall 3*a* forming the left and right inner end of the support post 3, and with an intermediate wall 3*e* formed in the left and right middle portion in the support post 3 so that the inner side wall 3*a* and the intermediate wall 3*e* are connected to each other by the outer rail 14.

With the above-described configuration, in the case where, due to an impact caused when the sheet receives a strong wind or is brought into contact with a person or an object, strong force acts to move both left and right ends of the sheet and the inner rails on both sides of the sheet inward in the left and right direction, the elastic sheet section made of the urging member is deformed by being curved or bent in the gap space, so that the resulting elastic force acts toward the side to reduce the strong force directed inward in the left and right direction, and thereby the impact is reduced. However, in this case, the elastic sheet section deformed by being curved or bent is brought into contact with only a part of the groove side surface because of the surface shape of the elastic sheet section. Thereby, the impact to the sheet and the wear of the urging member can be reduced without impeding the smooth movement of the inner rail in the left and right direction. Further, the gap space is partitioned by the elastic sheet section into the front and rear portions, and hence washing water, rain water, dust, and the like, can be efficiently prevented from entering the side of the groove side surface of the rail groove.

In addition, in the case where the elastic sheet section is made of a member without water permeability, even when the sheet shutter is used in a food factory, or the like, in which spray washing with tap water is performed daily, it is possible to efficiently prevent that the washing water permeates through the urging member to enter a portion near the groove side surface of the gap space.

Further, when the rail base is integrally extended in the front and rear direction from the bottom surface side end portion of the rail groove of the inner rail toward the groove side surface, and when the opposite wall extended in the front and rear direction from the open end side of the rail groove of the outer rail so as to face the rail base is integrally provided, and when the elastic sheet section is inserted between the rail base and the opposite wall, the positional deviation of the elastic sheet section can be suppressed, so that the elastic sheet section can be stably installed between the rail base and the opposite wall.

Further, when the guide corner section is formed by the rail base, and the engagement guide extended from the rail base toward the left and right inner side, and when the groove corner section is formed by the opposite wall and the groove side surface, and when the elastic sheet section is brought into contact with the guide corner section and the groove corner section so as to be provided in the gap space, the total length of the elastic sheet section can be secured to a maximum extent, and the two portions of the elastic sheet section can be stably positioned by the guide corner section and the groove corner section.

Further, when the plate-shaped opening side contact section, which is brought into surface contact with the opposite wall, is integrally formed at an end portion of the elastic sheet section near the groove corner section or when the plate-shaped bottom side contact section, which is brought into surface contact with the rail base, is integrally formed at an end portion of the elastic sheet section on the side of the guide corner section, the elastic sheet section can be more stably positioned and arranged by the surface contact between the opposite wall and the opening side contact section, or by the surface contact between the rail base and the bottom side contact section.

Further, when the opening side contact section is formed so as to close the gap space on the open end side of the rail groove, it is possible to more effectively prevent water, dust, and the like, from entering the inside of the rail groove.

Note that, when the rail base side end portion of the elastic sheet section is formed integrally with the rail base, the elastic sheet section is prevented from being detached from the inner rail, so that the elastic force can be stably applied to the inner rail from the elastic sheet section.

Further, in the case where the expanding/contracting section formed in the bellows shape by the plurality of foldable bending sections is provided in the elastic sheet section, the respective bending sections are orderly folded when the elastic sheet section is elastically deformed, while the respective bending sections are orderly expanded when the elastic sheet section is returned to the original shape. Thereby, the elastic force can be made to stably act in the left and right direction.

Further, when the outer rail is formed integrally with the inner wall forming the left-and-right inner end of the support post, and with the intermediate wall formed at the left-and-right intermediate portion in the support post so that the inner wall and the intermediate wall are connected by the outer rail, the strength of the support post and the outer rail can be increased while their thickness is reduced, and the weight of the support post and the manufacturing cost can be reduced.

DETAILED DESCRIPTION OF THE PREFERRED EMBODIMENTS

Embodiments according to the present invention will be described with reference to the drawings.

Figure 1:
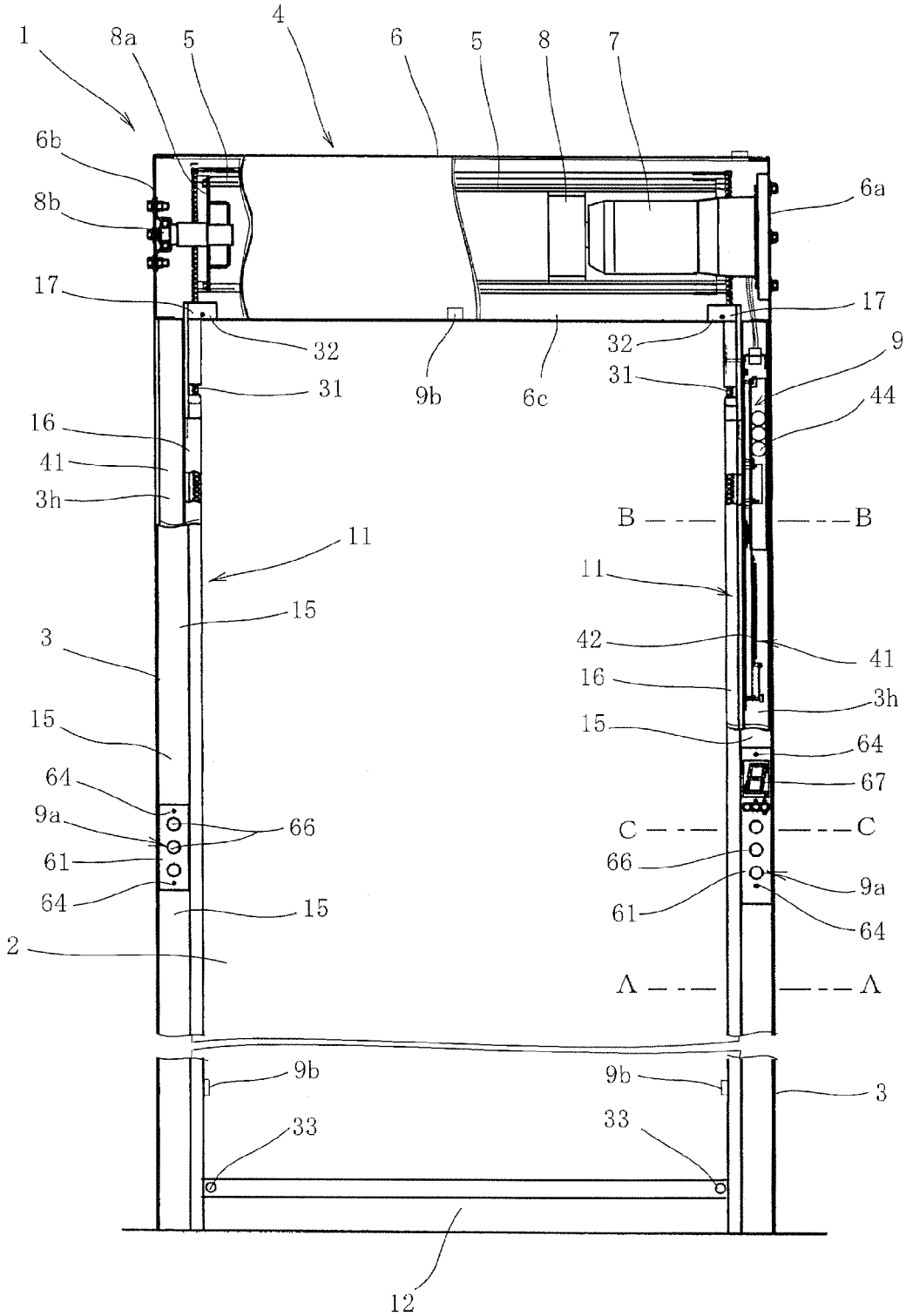
FIG. 1 is a front view partly in section showing a sheet shutter to which the present invention is applied.

FIG. 1 is a front view showing the whole of a sheet shutter according to the present invention. Reference numeral 1 denotes a sheet shutter installed mainly in an entrance of a building, and is configured by a support post 3 (side frame) which is configured as a guide member for supporting each of left and right end portions of a sheet 2 for the shutter so as to guide the vertical up and down movement of the sheet 2, a cylindrical sheet case 4 which incorporates an opening and closing mechanism of the sheet 2, and the like. The support post 3 is attached and fixed along a post or a wall which is arranged at the entrance of the building. The sheet case 4 is installed laterally along an installation portion, such as the beam or the wall surface of the building, and is attached in the state of being mounted on the left and right support posts 3.

In the sheet shutter 1 shown in FIG. 1, each side of the sheet case 4 is detachably mounted and attached to each of the left and right support posts 3 and 3, by an attaching member provided at an upper outer portion of the support post 3. Further, a sheet drum (unwinding apparatus) 5 is accommodated as a shutter opening and closing mechanism in the sheet case 4, and the winding and unwinding of the sheet 2 is performed by the normal and reverse rotation of the sheet drum 5. Each of the left and right sides of the sheet 2 is vertically slidably supported by each of sheet guides respectively provided in the left and right support posts 3, so that the entrance is opened and closed by the lifting and lowering movement of the sheet 2.

First, the entire configuration of the sheet shutter 1 will be described with reference to FIG. 1 to FIG. 8.

The sheet case 4 has a hollow case chamber formed by detachably attaching end plates 6*a* and 6*b* to both sides of a tubular case main body 6 having a quadrangular shape in cross-sectional side view. The hollow cylindrical sheet drum 5, which extends in the left and right direction and which is journaled by the left and right end plates 6*a* and 6*b* so as to be rotatable about the shaft of the sheet drum 5, is accommodated in the case chamber. Further, an opening section 6*c* facing the upper ends of the left and right support posts 3 is formed in the lower surface rear portion of the case main body 6, so that the sheet 2 can be taken in and out from the sheet case 4 via the opening section 6*c*.

One end side of a motor 7, which has a columnar shape extending in the left and right direction and which is accommodated in the sheet case 4, is fixed by screws to the inner surface of the end plate 6*a* on one side (right side in the illustrated example) of the left and right sides of the case main body 6. The motor 7 has a drive shaft for journaling a ring-shaped drive body 8 which is spline-fitted to the inner surface of the sheet drum 5 so as to thereby normally and reversely rotate the sheet drum 5.

The end plate 6*b* on the other side (left side in the illustrated example) of the left and right sides of the case main body 6 is attached so as to close the open end of the other side of the case main body 6, and rotatably supports a support shaft 8*b* of a mounting plate 8*a* attached to the other side end portion of the sheet drum 5. Thereby, the sheet drum 5 is horizontally journaled in the sheet case 4, and the sheet 2 is unwound and lowered (moved forward) or wound and lifted (moved backward) according to the normal or reverse rotation of the motor 7, so that the entrance of the building is closed or opened.

Further, the opening and closing operation of the sheet 2 is, similarly to a conventional sheet shutter, performed by controlling normal and reverse rotation of the motor 7 on the basis of a command, such as a manual operation command from an operating section (shutter electrical unit) 9*a* configured by various operation switches provided in a control panel (shutter electrical unit) 9, and a detection command from a detection section 9*b* for detecting a passing object. As will be described below, the control panel 9 has a configuration such that the control panel 9 is installed in the support post 3 so as to be able to be taken out.

The sheet 2 is formed by a translucent and flexible rectangular curtain made of synthetic resin, and the upper end (base side) of the sheet 2 is unwindably wound on the peripheral surface of the sheet drum 5. The sheet 2 shown in the figure has known piece-shaped guide projections 10 provided at a predetermined interval at the edge portion on each of the left and right sides of the sheet 2. A sheet guide section 11 is provided on each side of the mutually facing surfaces (opposite surfaces) of the left and right support posts 3 and 3, so that the guide projection 10 is vertically slidably and engagingly accommodated in the sheet guide section 11.

In this way, each of the left and right sides of the sheet 2 vertically slidably engages with each of the left and right sheet guide sections 11, and hence the sheet 2 is smoothly lifted and lowered between the left and right support posts 3 and 3 in a laterally stretched state. The sheet shutter 1 is installed on the installation surface, such as the ground surface or the floor surface, and further, a grounding section 12, which, when the sheet 2 is lowered to close the sheet shutter 1, brings the sheet 2 into contact with the installation surface in an air-tight manner, is provided at the lower end of the sheet 2. The grounding section 12 also serves as a weight section with a weight incorporated therein, so that the sheet 2 is vertically stretched by the weight.

Figure 4:
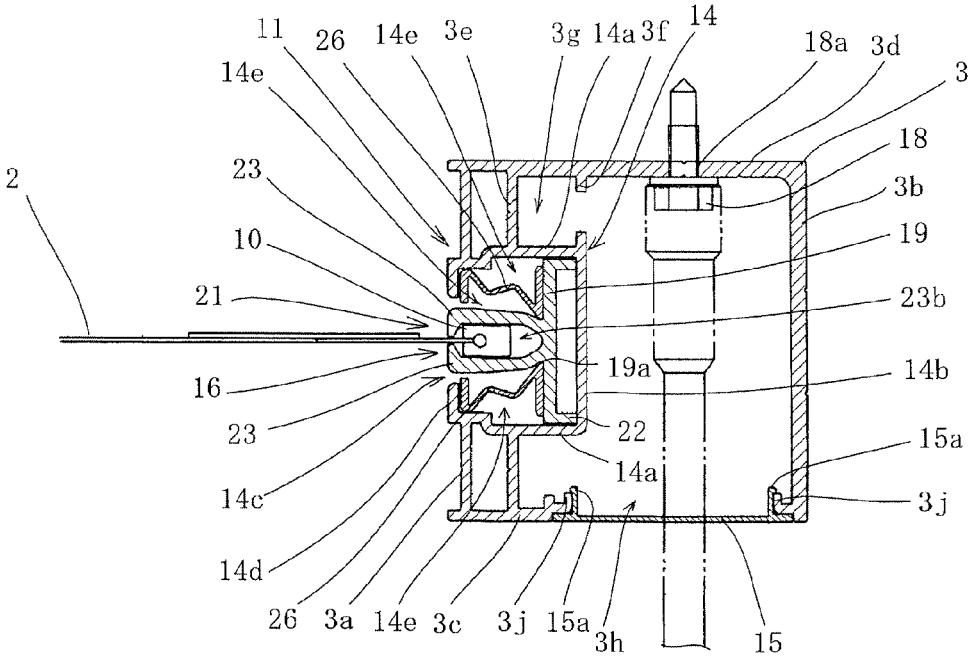
FIG. 4 is a sectional view along line A-A in FIG. 1.
Figure 8:
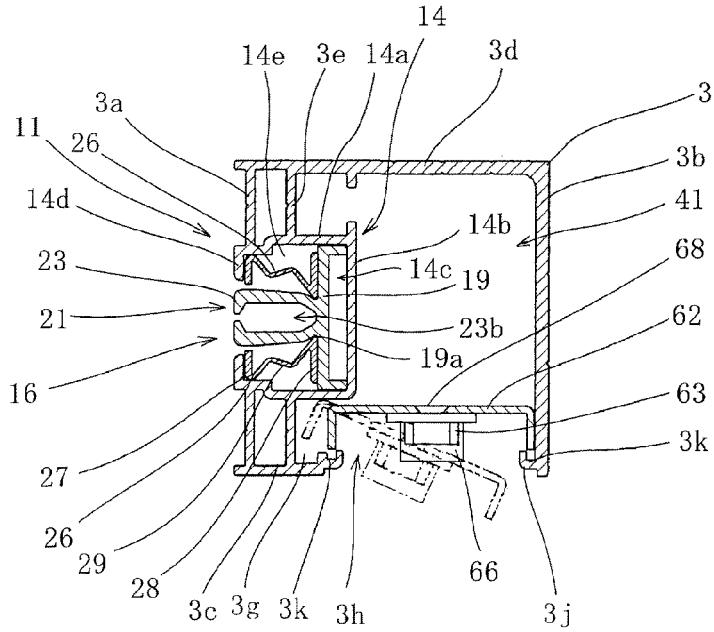
FIG. 8 is a sectional view showing a state where the operating section of FIG. 7 is disassembled.

The support post 3 is formed into a quadrangular shape in sectional plan view by an inner side wall 3*a* as the left and right inner end wall, an outer side wall 3*b* as the left and right outer end wall, and a front side wall 3*c* and a rear side wall 3*d* each serving as a connection wall for connecting the inner side wall 3*a* and the outer side wall 3*b* to each other, and is formed into a vertically extending quadrangular pillar shape. As shown in FIG. 4 and FIG. 8, an outer rail 14 formed into a U-shape recessed toward the outer side wall 3*b* in sectional plan view is integrally formed at the front-rear direction intermediate position of the inner side wall 3*a* of the support post 3.

Specifically, the outer rail 14 is formed by front and rear side walls 14*a* and 14*a*, and a bottom wall 14*b* which connects the left and right outer ends of the side walls 14*a* and 14*a* to each other. Thereby, a vertically directed rail groove 14*c* opened on the left and right inner side is formed on the side of the opposite surface of each of the support posts 3. In other words, the rail groove 14*c*, which is recessed toward the left and right outer side in sectional plan view and which extends in the vertical direction, is formed by the mutually facing surfaces (groove side surfaces) of the front and rear side walls 14*a* and 14*a*, and the left and right inner surface (bottom surface) of the bottom wall 14*b*.

Further, an inner rail 16 and a sheet return guide 17 connected to the upper portion of the inner rail 16 are detachably fitted into the rail groove 14*c* from an end portion of the rail groove 14*c* in the whole length direction of the rail groove 14*c*. Further, vertically directed inner groove walls (opposite walls) 14*d* respectively projecting in the front and rear direction in sectional plan view from the left and right inner end portions of the front and rear side walls 14*a* and 14*a* so as to be close to each other are integrally formed. An opening section of the rail groove 14*c* is formed between the pair of front and rear inner groove walls 14*d* and 14*d* provided at each of the outer rails 14. In other words, the pair of front and rear inner groove walls 14*d* and 14*d* are arranged at the open side of the rail groove 14*c*, and a vertically extending groove corner 14*f* is formed at each of the borders between the inner groove walls 14*d* and 14*d* and the side walls 14*a* and 14*a*.

Further, the front and rear side walls 14*a* forming the groove side surfaces located on both sides of the rail groove 14*c* are respectively connected integrally with the front and rear connection walls 3*c* and 3*d* by intermediate walls 3*e* extending in the front and rear direction in sectional plan view. In other words, the outer rail 14 is formed integrally with the inner side wall 3*a* and the intermediate wall 3*e* so that the front and rear inner side walls 3*a* and 3*a* located at each of the left and right inner ends of the support posts 3 and the front and rear intermediate walls 3*e* and 3*e* in the support post 3 are connected by the outer rail 14.

Thereby, the strength of the support post 3, which is required to be formed in a predetermined diameter or less, can be improved without particularly increasing the thickness of the outer rail 14 which receives a large internal load in the front and rear direction. As described above, since the strength of the support post 3 can be sufficiently increased by the cross-sectional shape of the outer rail 14 and of the intermediate wall 3*e*, it is possible to reduce the weight and the manufacturing cost of the support post 3 without uselessly increasing the diameter of the support post 3.

Further, the outer rail 14 is located near the left and right inner side in the support post 3, and is formed in a size which is equal to or smaller than one-half of the plan sectional area of the inside of the support post 3 (specifically, the bottom wall 14*b* is located near the inner side wall 3*a*). Thereby, a multi-purpose space, in which the electrical unit, such as the control panel 9 and the operating section 9*a*, and the other components are efficiently accommodated, can be secured in the support post 3 whose plan sectional area (diameter) is restricted.

Further, a wiring space 3*g* extending in the direction of the support post 3 is formed between each of the side walls 14*a* and 14*a* and each of the front and rear connection walls 3*c* and 3*d*. In addition, vertically directed rib-shaped projecting sections 14*g* and 3*f*, which are located on the side of the bottom wall 14*b* in front view and which are projected in the direction close to each other, are integrally formed on the side wall 14*a* on one of the front and rear sides (rear side in the illustrated example) and the connection wall 3*d* on the side facing the side wall, respectively. With the pair of projecting sections 14*g* and 3*f*, the wire harness 13, and the like, is surely positioned and accommodated in the wiring space 3*g*, and the rigidity of the support post 3 is also increased by the rib structure (see FIG. 6).

Further, since the strength of the support post 3 is increased as described above, a vertically directed support post opening section 3*h* can be formed by opening a part of the connection wall 3*c* (more specifically the front side wall 3*c*). This support post opening section 3*h* is formed along the whole length direction of the support post 3, to facilitate multi-purpose use of a support post space 41 described below. Specifically, rib-shaped opening edges 3*j* projecting in the support post 3 are respectively formed at both the left and right end sides of the support post opening section 3*h* formed in the connection wall 3*c*, while engagement pieces 15*a* and 15*a* projecting in the support post 3 are respectively formed at both the left and right end portions of a lid cover 15 that is a plate-shaped member, the thickness direction of which is directed in the front and rear direction and which is formed in a belt shape extending in the direction of the support post 3. When the pair of engagement pieces 15*a* and 15*a* are respectively detachably engaged with the pair of opening edges 3*j* and 3*j*, the lid cover 15 is fitted into the support post opening section 3*h*, so as to close the support post opening section 3*h*, while, when the engagement between the engagement pieces 15*a* and 15*a* and the opening edges 3*j* and 3*j* is released, the support post opening section 3*h* is opened.

Further, in the left and right middle portion of the rear side wall 3*d* of the support post 3, a plurality of bolt holes 18*a*, into which attachment bolts 18 are inserted, are bored along the whole length direction of the support post 3. Thus, the support post 3 can be easily fixed in such a manner that the bolt 18 is taken into the support post 3 from the support post opening section 3*h* opened by removing the lid cover 15, and that the bolt 18 is inserted and secured to the bolt hole 18*a* and a building, or the like, to which the sheet shutter 1 is installed. Note that the support post 3 configured as described above can be simply manufactured by drawing or extrusion processing of an aluminum material similarly to a conventional support post frame made of aluminum. Further, it is preferred that the lid cover 15 is formed in a belt-shaped plate made of synthetic resin. Thereby, the lid cover 15 can be formed by cutting the belt-shaped plate according to the length of the vertically directed support post opening section 3*h* through which the operating section 9*a* is installed in a middle portion of the support post. Thus the lid cover 15 can be attached in fine appearance so as to cover the support post opening section 3*h*.

Next, the inner rail 16 will be described with reference to FIG. 4 to FIG. 9.

The inner rail 16 is formed in the vertical direction over the whole length in the length direction of the rail groove 14*c* of the outer rail 14, and is configured by a rail base 19 formed long in the front and rear direction along the bottom surface of the rail groove 14*c* in sectional plan view, and by an engagement guide 21 projecting from the front and rear direction middle portion of the rail base 19 to the left and right inner side in sectional plan view.

Guide sections (fitting section) 22 and 22 extending to both the left and right sides in sectional plan view are integrally formed at the front and rear end portions of the rail base 19, respectively. The inner rail 16 is accommodated in the rail groove 14*c* slidably in the left and right direction in such a manner that the rail base 19 is fitted between the front and rear side walls 14*a* and 14*a* of the rail groove 14*c* so as to allow the pair of guide sections 22 and 22 to be brought into surface contact with the front and rear side walls 14*a* and 14*a*, respectively. The pair of fitting sections 22 allows the inner rail 16 to stably slide in the left and right direction and improves the flexibility and durability of the rail base 19 without increasing the thickness of the rail base 19.

The engagement guide 21 is formed into front and rear forked portions so as to project toward the left and right inner side in sectional plan view, and thereby has a pair of front and rear holding bodies 23 and 23. In addition, a vertically directed guide corner section 19*a* is formed at a connection portion between a base end portion that is a left and right outer end portion of the engagement guide 21, and the rail base 19. The tip portion of the engagement guide 21 is arranged at the open side of the rail groove 14*c*.

The projecting end portions (tip portions), which are the left and right inner end portions of the front and rear holding bodies 23 and 23, are curved or bent in the front and rear direction close to each other in sectional plan view, so that each of the holding bodies 23 and 23 is formed into a hook shape. For this reason, a grasping section 23*a* for grasping the front and rear surfaces of the left and right end portion of the sheet 2 is formed between the tip portions of the holding bodies 23 and 23, while a bag-shape guide groove 23*b* extending in the vertical direction is formed between the base end portions of the front and rear holding bodies 23 and 23.

The sheet 2 whose front and rear surfaces are grasped by the grasping section 23*a* is guided to be lifted and lowered in the state where rocking movement in the front and rear direction is regulated. The above-described guide projection 10 is accommodated in the guide groove 23*b* in the state where the left and right movement is permitted and where the front and rear movement is regulated. In this case, each of the front and rear holding bodies 23 and 23 has substantially the same thickness over the whole length thereof, and thereby can be elastically curved or bent to the side of separating from each other. Thus, the guide groove 23*b* can be opened by the curving or bending toward the separation side.

Thereby, as shown in FIG. 4, the sheet 2 is made to slide in the vertical direction while each of the guide projections 10 provided on the left and right end sides of the sheet 2 is accommodated in the guide groove 23*b* of the engagement guide 21 and is prevented from coming off in the left and right inward direction. That is, even when the sheet 2 receives a wind pressure at the time of lifting or lowering so that the guide projection 10 widens the sheet groove 23*a* so as to come off from the guide groove 23*b*, the coming-off of the guide projection 10 is prevented by the hook-shaped projecting end portion of the holding body 23, and hence the sheet 2 can be guided to be smoothly lifted or lowered. Note that the inner rail 16 and the sheet return guide 17 are formed by a synthetic resin material having abrasion resistance and a certain amount of flexibility.

In the above-described structure, a pair of groove space sections (gap spaces) 14*e* are formed between the front and rear groove side surfaces of each of the vertically directed rail grooves 14*c* and the engagement guide 21 of the inner rail 16. Each of the groove space sections 14*e* respectively formed in the front and rear portions in the inner rail 16 is in the state where the four sides of each of the groove space sections 14*e* are surrounded by the engagement guide 21, the rail base 19, the inner groove wall 14*d*, and the side wall 14*a* in sectional plan view.

In each of the groove space sections 14*e*, an elastic film member (urging member) 26, which elastically urges the inner rail 16 toward the left and right outer side by a curving deformation or a bending deformation thereof (bending deformation in the illustrated example), is provided so as to partition the groove space section 14*e* into front and rear portions. The guide projections 10 and the left and right end portions of the sheet 2 are also elastically pulled toward the left and right outer side by the elastic urging force directed toward the left and right outer side of the inner rail 16. Since the elastic film member 26 prevents foreign matters, such as water and dust, from entering the inner side of the rail groove 14*c*, it is possible to provide a sheet shutter which is excellent in durability and which has high quality.

Figure 5:
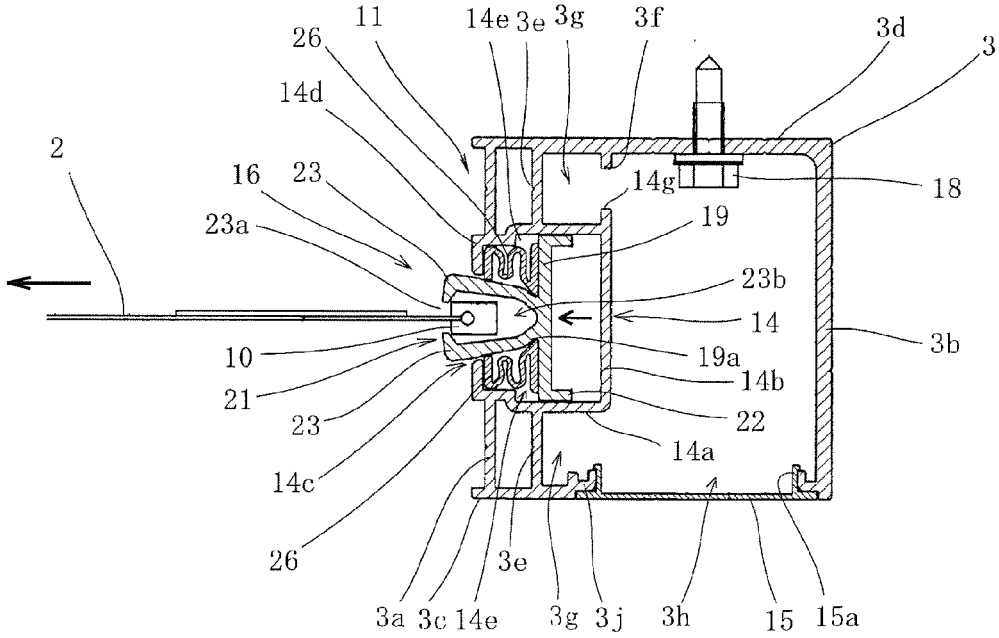
FIG. 5 is a sectional view showing a state where the inner rail of FIG. 4 is moved toward the inner side.
Figure 9:
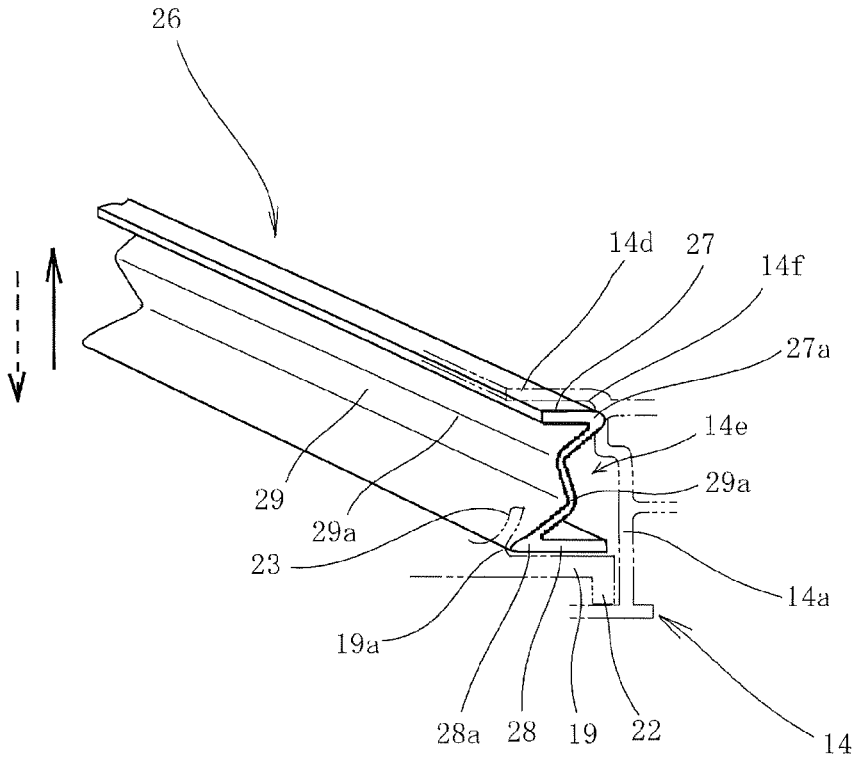
FIG. 9 is a perspective view of an elastic film member.

That is, as shown in FIG. 4, FIG. 5 and FIG. 9, the elastic film member 26 is made of rubber or synthetic resin, and is integrally formed into a Z-shape in sectional plan view by including an inner seat surface (opening side contact section, sealing section) 27 having a width for surface contact with the inner surface of the inner groove wall 14*d*, an outer seat surface (bottom side contact section, sealing section) 28 having a width for surface contact with the rail base 19, and an elastic film section (elastic sheet section) 29 which connects the inner seat surface 27 and the outer seat surface 28 to each other and which has flexibility and elasticity in the pulling direction (sheet stretching direction).

In other words, the plan sectional shape of the elastic film section 29 is formed in the oblique direction between the groove corner section 14*f* and the guide corner section 19*a* so that the front and rear edge portions of the elastic film section 29 are respectively brought into contact with the groove corner section 14*f* and the guide corner section 19*a*. Further, the inner seat surface 27 is integrally formed at the end portion (inner corner section 27*a*) of the elastic film section 29 on the side of the groove corner section 14*f*, and also the outside seat surface 28 is integrally formed at the end portion (outer corner section 28*a*) of the elastic film section 29 on the side of the guide corner section 19*a*. In addition, the inner seat surface 27 is formed into a shape which has a front and rear width smaller than that of the outer seat surface 28 and which has a length enough to close or substantially close each of the opened left and right inner ends of the groove space sections 14*e*.

Further, the thickness of the elastic film section 29 is set to about several millimeters. Also, a bending section 29*a* or a curving section (a plurality of bending sections 29*a* in the illustrated example) bent in a bellows shape in plan sectional view is formed in the middle portion of the elastic film section 29. For this reason, as shown in FIG. 5, when strong compressive force in the left and right direction is applied to the elastic film member 26, the expanding/contracting section formed by the plurality of bending sections 29*a* of the elastic film section 29 is regularly folded so as to be contracted in the left and right direction, and applies, as the tensile force toward the left and right outer side, the elastic force corresponding to the amount of compression of the expanding/contracting section to the inner rail 16. In this way, the elastic film section 29 is expanded and contracted in the left and right direction, but in this case, the elastic film section 29 formed in the bellows shape is smoothly expanded and contracted, so that the elastic film section 29 is suppressed from being shifted in the front and rear direction.

For this reason, even when the elastic film member 26 is contracted, it is possible to suppress the elastic film section 29 from being brought into contact with the side wall 14*a* or with the engagement guide 21. Thus, even in long time use, damage and degradation of the elastic film section 29 can be prevented, and hence the stable pulling performance and high durability of the sheet 2 can be maintained.

Therefore, the inner rail 16 can be smoothly moved in the left and right direction without receiving the movement resistance which, when the inner rail 16 is moved inward, is caused by the elastic member being compressed and swelled into slide contact with the side wall 14*a*, as in the case where the elastic member having the block-shaped cross section is provided in the groove space section 14*e*. Further, the sheet 2 can be stably stretched without the unreasonable state of the sheet 2 and the guide projection 10 being caused due to the movement resistance.

Further, the elastic film member 26 connects the inner groove wall 14*d* and the rail base 19 to each other by the elastic film section 29 which is not made of sponges having air permeability and water absorbability but is made of rubber or synthetic resin so as to have elasticity and sealing function. Thereby, water and dust entering from the outside of the rail groove 14*c* can be surely prevented from entering the inside of the groove space section 14*e*, without passing through the elastic film section 29. Thus, for a long period, it is possible to prevent, for example, a trouble that water and dust sucked in a sponge or in an elastic member made of a brush material or a fiber material enter the gap between the rail base 19 and the side wall 14*a* so as to be solidified to cause the movement resistance.

Further, the elastic film section 29 is installed in the groove space section 14*e* in the state where the both ends of the elastic film section 29 are respectively brought into contact with the groove corner section 14*f* formed by the inner side wall 3*a* and the side wall 14*a*, and with the guide corner section 19*a* formed by the base side of the engagement guide 21 and the rail base 19. Thus, the elastic film section 29 has the following operation effects. That is, the elastic film section 29 is, while having elasticity, installed in the groove space section 14*e* having a rectangular cross-sectional shape, in the state where the stretching distance in the diagonal direction is long. Thus, a large bending margin can be secured without the elastic film section 29 being forcibly bent when being contracted, and hence early deterioration of the film portion can be prevented and the durability of the film portion can be improved.

Further, the end portion near the left and right outer side (the bottom side of the rail groove 14*c*) of the elastic film section 29 is brought into contact with the guide corner section 19*a* on the base side of the engagement guide 21, and hence the groove space section 14*e*, which is partitioned by the elastic film section 29 and is near the outer side, can be converged toward the deep side. Therefore, in the case where the sheet 2 is washed by spraying tap water on the sheet 2, even when the water rapidly enters the inside of the groove space section 14*e* near the outer side, since the groove space section 14*e* near the outer side is converged towards the deep side, the entering of the water into the groove space section 14*e* near the inner side can be regulated. Further, the groove space section 14*e* near the outer side is a converged narrow space and hence has advantages such as that dirt is easily removed by a stream of washing water and that the washed portion can be easily dried by promoting drainage of washing water.

Further, when the elastic film member 26 is formed into a Z-shaped cross-sectional shape, the inner seat surface 27 and the outer seat surface 28 are respectively brought into close contact with the inner groove walls 14*d* and the rail base 19 in large areas so that the entering of water can be prevented without requiring adhesive. Also, the elastic film member 26 can be easily attached and detached, and hence the assembling and disassembling of the sheet stretching mechanism can be easily performed.

Note that in the illustrated elastic film member 26, the inner seat surface 27 and the outer seat surface 28 are formed in the elastic film section 29, but the elastic film section 29 can also be formed as an elastic and flexible belt-shaped plate made of, for example, synthetic resin or steel. In this case, it is preferred that the elastic film member 26 is positioned and fitted to the groove corner section 14*f* and the guide corner section 19*a*.

Next, there will be described a mode in which the elastic film member 26 configured as described above is installed in the support post 3.

First, the inner rail 16 and the sheet return guide 17 are inserted and set in the rail groove 14*c* from a whole length direction end portion of the rail groove 14*c*. Then, the elastic film member 26 is inserted and set in the groove space section 14*e* from the whole length direction end portion of the rail groove 14*c*. Thereby, the installation operation of the elastic film member 26 can be simply and efficiently performed. At this time, when the elastic film member 26 is contracted against the elasticity of the elastic film section 29, the elastic film member 26 can be easily inserted into the groove space section 14*e* from the end portion of the rail groove 14*c* in the state where the inner seat surface 27 and the outer seat surface 28 are set close to each other.

When the elastic film member 26 inserted in this way is set in a free state in the groove space section 14*e*, the inner corner section 27*a* can be positioned at the groove corner section 14*f* of the groove space section 14*e*, which is formed by the inner groove wall 14*d* and the side wall 14*a*, while the outer corner section 28*a* can be positioned in the state of entering the guide corner section 19*a* of the inner rail 16. Therefore, the elastic film member 26 can be simply and quickly arranged in the support post 3. Further, the inner seat surface 27 and the outer seat surface 28 are respectively brought into close contact with the inner groove wall 14*d* and the rail base 19 at the same time, and hence the elastic film member 26 can be stably fixed in the groove space section 14*e* even without the use of adhesive, and the like. Thereby, the elastic film member 26 without water permeability and air permeability can partition the groove space section 14*e* into the front and rear portions. Thus, even when washing water, rain water, dust, and the like, enter the outer side of the groove, the entering of these into the inner side of the groove can be surely prevented.

In the sheet shutter 1 including the sheet stretching mechanism configured as described above, when the sheet 2 receives strong force by a strong wind, or the like, in the front and rear direction perpendicular to the sheet surface, the inner rail 16 receives inward tensile force via the sheet 2 and the guide projection 10 as shown in FIG. 5. At this time, the inner rail 16 is slid inward against the elastic force of the elastic film member 26 in the outer rail 14, and hence the tensile force due to the wind can be reduced.

Further, in such a case where a passing object, such as a vehicle, collides with the sheet 2, the inner rail 16 is moved inward as shown in FIG. 5 while the sheet 2 is strongly pressed in the front and rear direction. Thereby, the elastic film member 26 is held in the folded state to reach the inward movement limit (slide limit), so that the guide projection 10 acts to forcibly widen the space between the holding bodies 23 and 23 against the elastic force of the holding bodies 23 and 23, while the guide projection 10 is inclined in the pressing direction.

Then, the guide projection 10 presses the holding bodies 23 and 23 to elastically widen the space between the holding bodies 23 and 23. Thereby, the guide projection 10 comes off from the widened sheet groove 23*b* of the engagement guide 21, so as to be detached from the inner rail 16. Therefore, the sheet 2, which is detached from the inner rail 16 to lose the support of the support post 3, is released from the tension forcibly applied by the pressing force, and hence the sheet 2 and the guide projection 10 is prevented from being damaged. Further, the inner rail 16, the associated member, and the like, can also be prevented from being subjected to an overload, and hence their breakage can be prevented.

Next, the sheet return guide 17 will be described with reference to FIG. 10 to FIG. 13.

Figure 12:
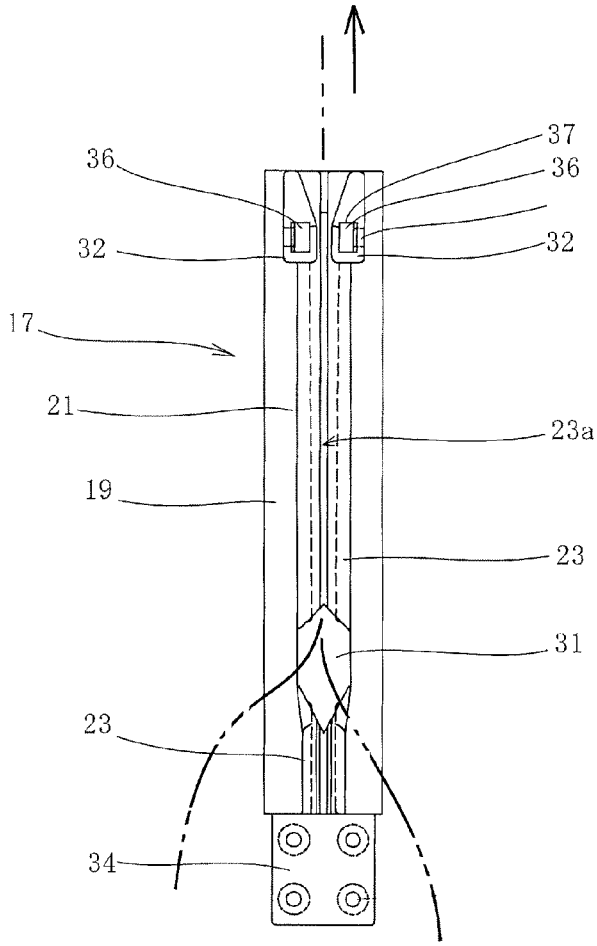
FIG. 12 is a front view of the sheet return guide.
Figure 13:
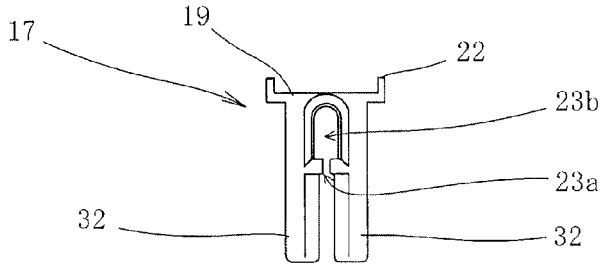
FIG. 13 is a plan view of FIG. 12.

The sheet return guide 17 is connected and installed at an upper portion of the inner rail 16 in the support post 3 via the outer rail 14, as shown in FIG. 1. Thereby, the sheet return guide 17 guides the winding and unwinding of the sheet 2. Also, when the sheet 2 detached from the inner rail 16 as shown by the dotted line in FIG. 12 is wound and pulled up, the sheet return guide 17 returns the sheet 2 to the original attitude, so as to enable the sheet 2 to be unwound again in a proper attitude. The sheet return guide 17 is made of synthetic resin, and has substantially the same cross-sectional shape as that of the inner rail 16. That is, in the sheet return guide 17, the rail base 19 is formed in the middle portion of the guide body portion, and the guide groove 23*b* for accommodating the guide projection 10 is formed in the engagement guide 21.

Further, in the sheet return guide 17, a return groove 31, which is formed as a notch having a vertical width for introducing the detached sheet 2, is provided in the middle portion of the engagement guide 21. In the holding bodies 23 and 23 respectively located on the upper and lower sides of the return groove 31, the entry portion of each of the upper and lower ends on the side of the return groove 31 is formed by V-shaped inclined planes. Thereby, the inclined end surfaces at the entry portion of each pair of the holding bodies 23 and 23 smoothly guide and introduce the sheet 2 and the guide projection 10 into the grasping section 23*a* and the guide groove 23*b* from above or below the return groove 31.

Further, sheet stopper pieces 32 formed by extending the holding bodies 23 inward are integrally projected at the upper portion of the guide main body of the sheet return guide 17. When a malfunction is caused during the winding operation of the sheet 2, the sheet stopper piece 32 receives a stopper 33 provided on each side of the grounding section 12 to restrict the further lifting of the sheet 2, and thereby the grounding section 12 is prevented from being caught.

In the restricted state, since the sheet drum 5 is rotated until the rotation of the motor 7 is stopped by the detection command of overload detection means, the wound sheet 2 is tightly wound to remove bulging and creases caused at the time of winding, and thereby the winding diameter is properly corrected so that the winding diameters on the right and left sides of the sheet 2 are made substantially equal to each other. In this way, when, after the rotation of the motor 7 is stopped by the command of overload detection, the sheet drum 5 is rotated to unwind the sheet 2, the slack at the early stage of the lowering can be removed, and the inclination of the grounding section 12 can be prevented so as to bring the grounding section 12 into proper contact with the ground or the floor surface.

Figure 10:
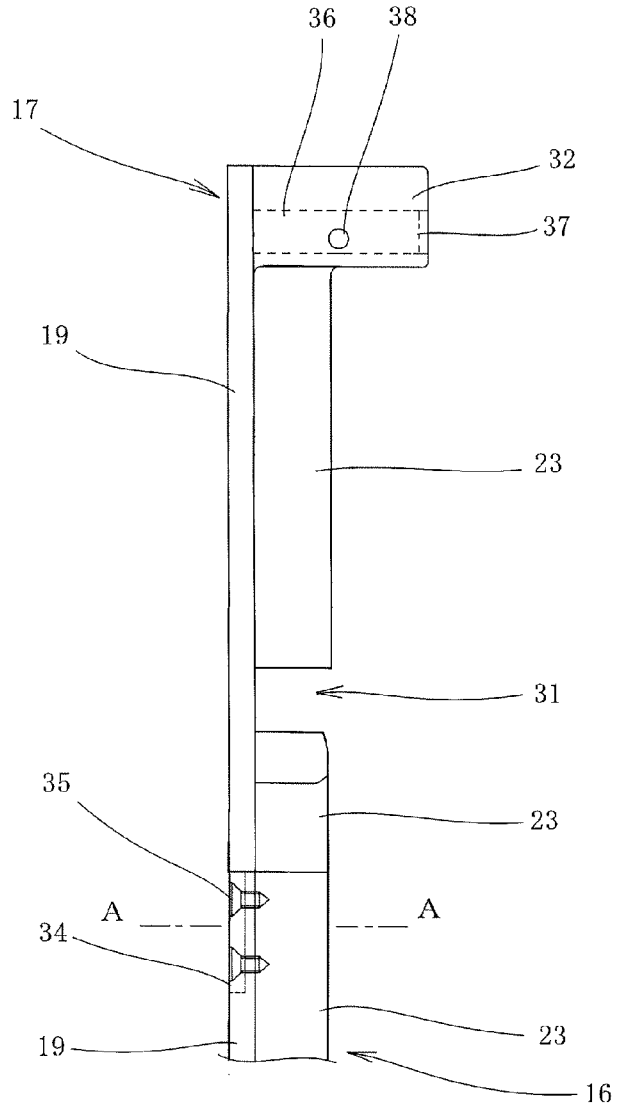
FIG. 10 is a side view of a sheet return guide and the inner rail.
Figure 11:
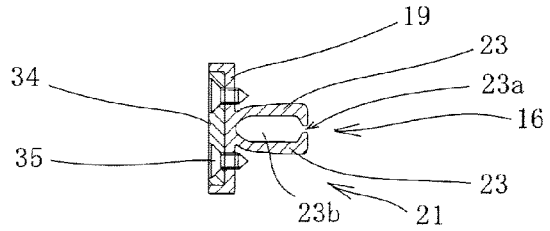
FIG. 11 is a sectional view along line A-A in FIG. 10.

The sheet return guide 17 can be connected in such a manner that a connection piece 34 projected from the lower end of the rail base 19 is detachably fitted to the rail base 19 of the inner rail 16 as shown in FIG. 10 and FIG. 11. That is, the connection piece 34 projected from the lower end of the sheet return guide 17 is connected to the rail base 19 of the inner rail 16 by four screws 35, so that the sheet return guide 17 is flexibly supported by the elastic film member 26 extended from the side of the inner rail 16. Thereby, the inner rail 16 and the sheet return guide 17 can be both easily assembled and disassembled by simple operations, such as inserting and extracting operations in the rail direction. Thus, maintenance work, such as parts replacement of the sheet stretching mechanism, can be easily performed.

Further, in the sheet return guide 17, a lubrication member 36, which is made of an oil containing material, such as felt, and which is brought into contact with the guide projection 10 to supply lubricant to the guide projection 10, is provided in the thick sheet stopper piece 32 projecting inward from the side of the engagement guide 21. In the state where the lubrication member 36 is inserted into a lubrication hole section 37 which is laterally bored in the sheet stopper piece 32 and which has a rectangular cross-section, the lubrication member 36 is arranged in the guide groove 23*b* while retaining the lubricating oil supplied from a supply hole 38. Thereby, at the uppermost position of the support post 3, lubrication can be simply and uniformly performed by the lubrication member 36 over substantially the whole range of the lifting and lowering movement of the guide projections 10. Further, the sheet 2 can be smoothly lifted and lowered while the wear and the noise of the respective sliding portions are suppressed.

Next, a mounting structure of electrical unit for control of the sheet shutter, which unit is installed in the support post 3, will be described with reference to FIG. 1 to FIG. 3, FIG. 6, FIG. 14 and FIG. 15.

In the support post 3 in which the sheet stretching mechanism is configured as described above, the support post space (storage space) 41 that is a multi-purpose space in which various electrical units and articles can be stored besides the control panel 9 for controlling the rotation of the sheet drum 5 is first formed near the opposite side (near the left and right outer side) of the outer rail 14 in the support post 3 so as to occupy half or more of the internal area of the support post 3 in plan sectional view.

Figure 6:
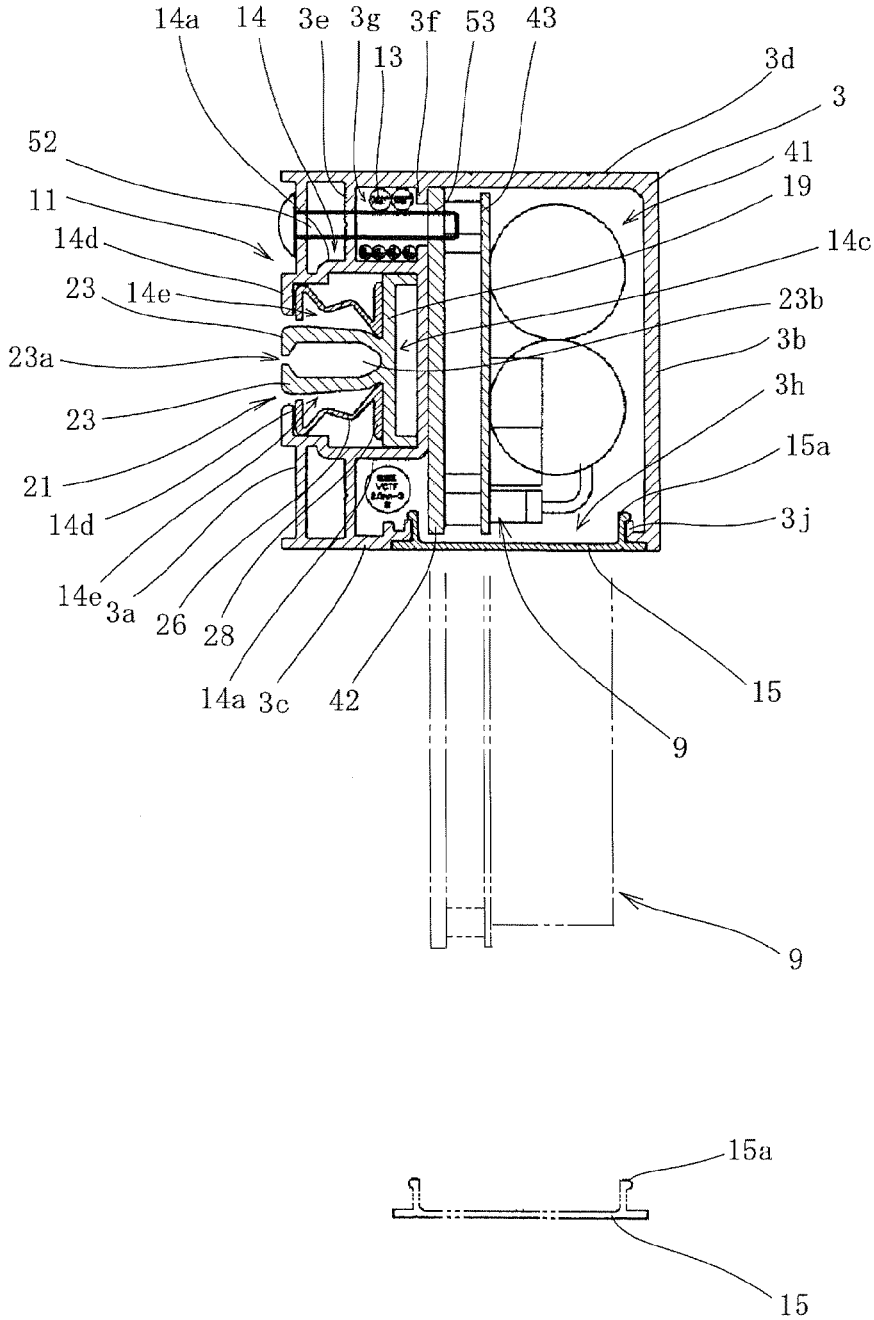
FIG. 6 is a sectional view along line B-B in FIG. 1.
Figure 7:
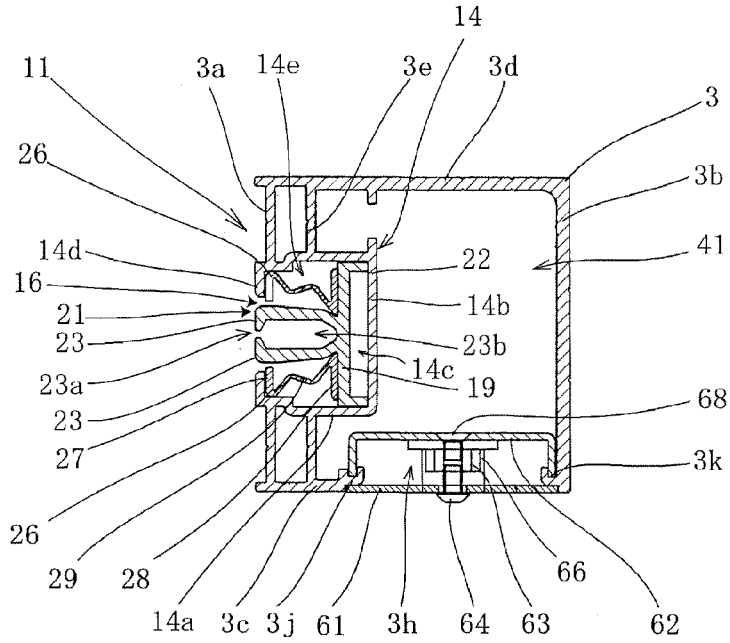
FIG. 7 is a sectional view along line C-C in FIG. 1.
Figure 14:
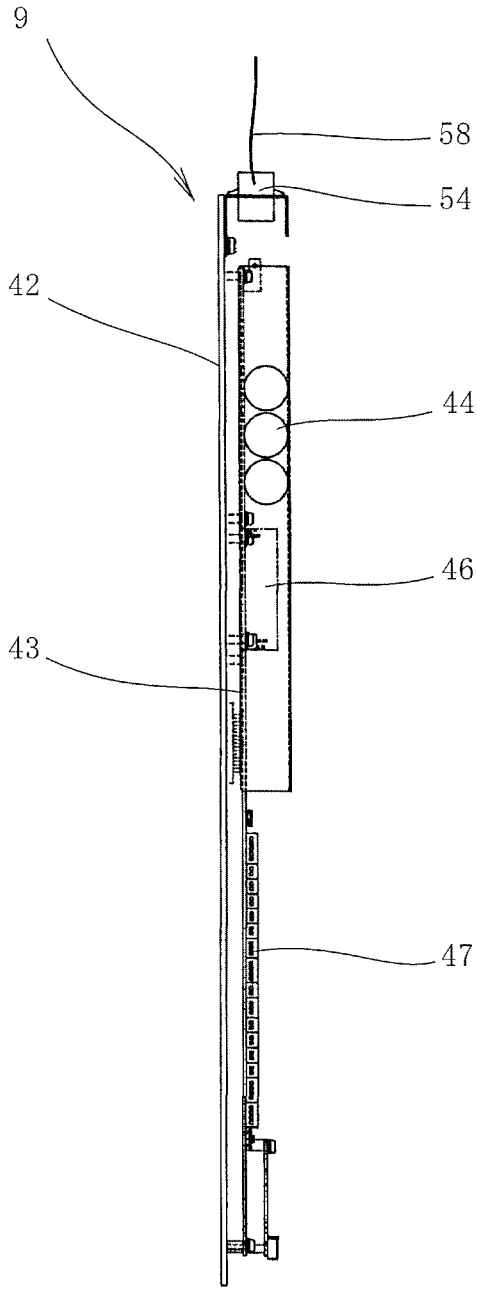
FIG. 14 is a front view of the control panel.
Figure 15:
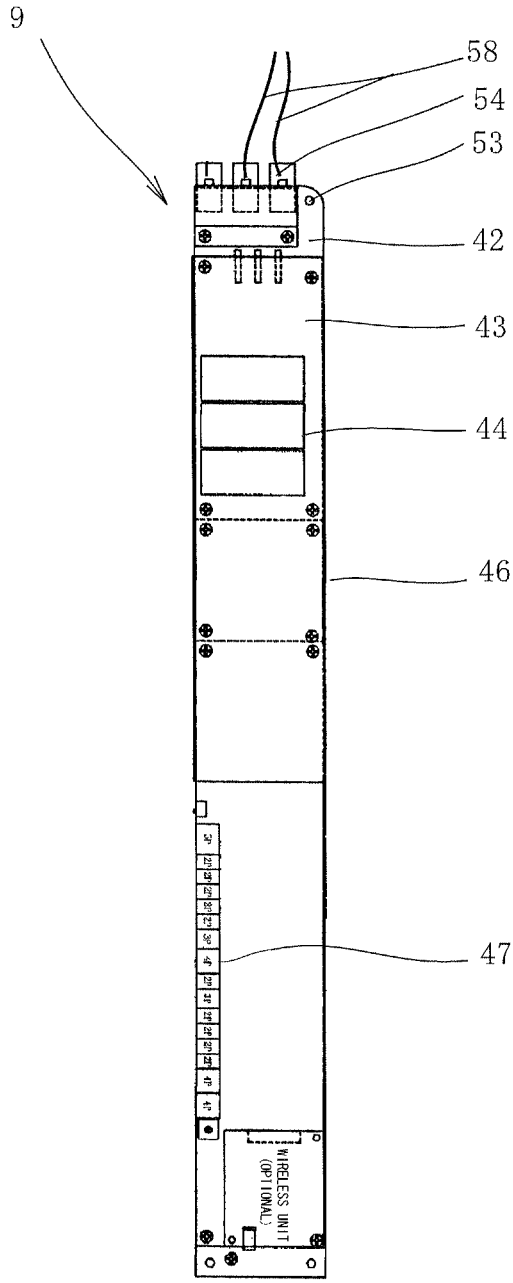
FIG. 15 is a side view of FIG. 14.

Further, as shown in FIG. 6, FIG. 14 and FIG. 15, the control panel 9 is configured as a unit by assembling an electrical base 42 formed in a predetermined length and a predetermined front and rear width which can be accommodated in the support post space 41, a substrate 43 attached to the electrical base 42 via an attaching seat, and electrical components, such as a control component section 44, a converter device 46, and setting devices 47, which are provided on the substrate 43.

Figure 2:
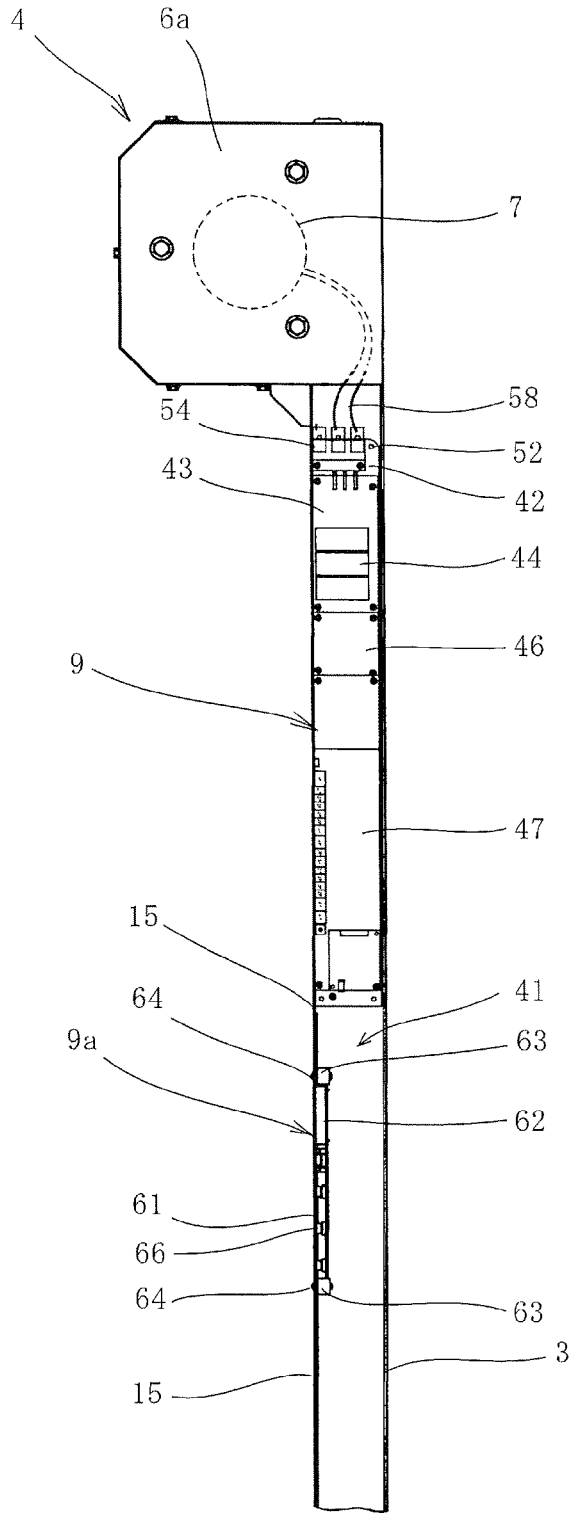
FIG. 2 is a sectional side view showing a state where a control panel is accommodated in a support post of the sheet shutter.

A mounting hole 53 for receiving therethrough a bolt (attaching member) 52 which is inserted through the inner side wall 3*a* and the intermediate wall 3*e* and which is located in the rear portion in the support post 3, is bored in the electrical base 42, and the electrical base 42 is screwed to the support post 3 by the mounting bolt 52. Thereby, as shown in FIG. 2, in the state where the control panel 9 is accommodated in the support post space 41, the electrical base 42 (control panel 9) can be detachably attached and fixed along the direction of the support post 3 by fastening the bolt 52. Further, the electrical base 42 can be brought into contact with the objecting section 3*f* and the bottom wall 14*b*, and is fixed so that the left-and-right and front-and-rear directed rocking of the control panel 9 is simply prevented.

At this time, in the control panel 9, electrical components and the control component section 44 which are not to be subjected to vibration, and electrical components with many wirings, and the like, are arranged on the upper side of the substrate 43. The setting devices 47, and the like, which require routine maintenance work and which need to be operated, are arranged on the lower side of the substrate 43. Further, a terminal section 54 for collecting and fixing various wirings is installed at the uppermost portion of the substrate 43. Further, the terminal section 54 is connected to a connector of an electric wire 58 extended from the motor.

Thereby, when the left and right engagement pieces 15*a* and 15*a* of the lid cover 15 are engaged with the left and right opening edges 3*j* and 3*j* in the state where the control panel 9 is accommodated in the support post 3, the support post opening section 3*h* formed to open the front side of the storage space 41 can be easily closed.

Figure 3:
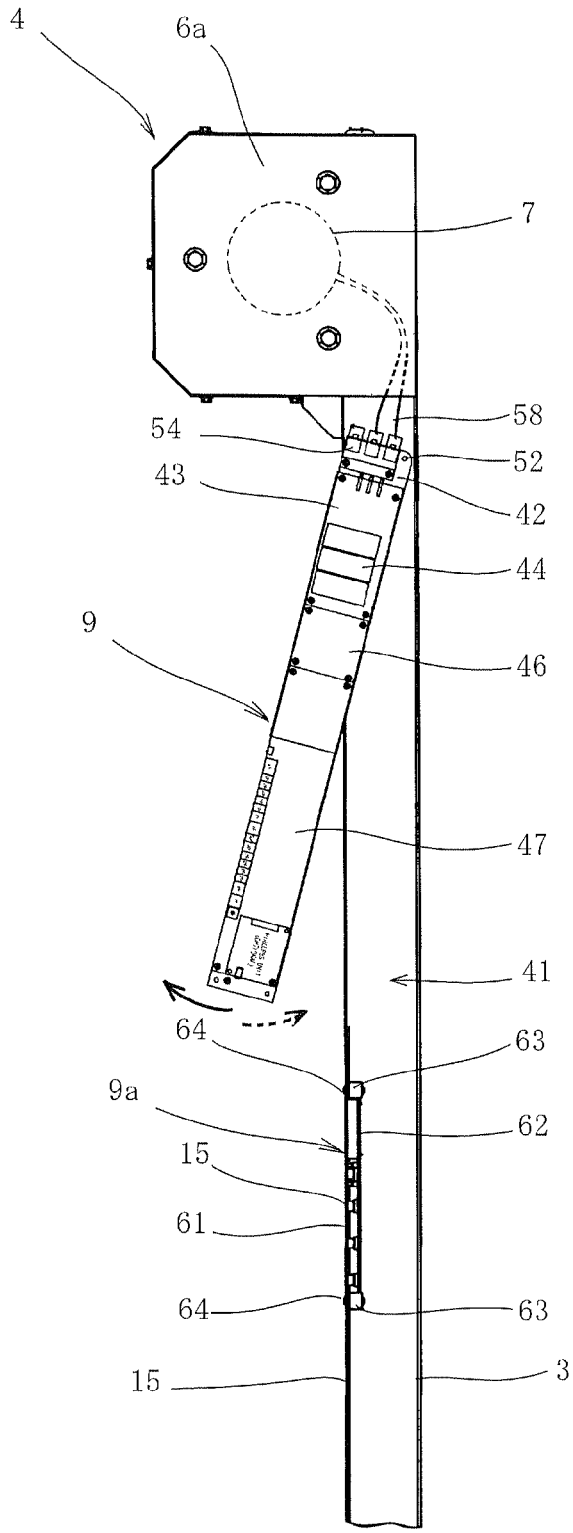
FIG. 3 is a sectional side view of FIG. 2, showing an attitude in which the control panel is taken out.

Further, when the control panel 9 is to be taken out, the above-described operations are performed in reverse order so that, when the bolt 52 is loosened after the lid cover 15 is removed, and then when the control panel 9 is rotated forward using the bolt 52 as a fulcrum (the lower end portion of the electrical base 42 is rotated forward using as a fulcrum the upper end portion of the electrical base 42), the accommodated attitude can be changed to the extracted attitude in which the lower side of the control panel 9 is largely extracted and exposed to the front outer side of the support post 3 as shown with FIG. 3. Thereby, the worker can easily perform maintenance work of necessary portions of the control panel 9 in the exposed state. At this time, the setting devices 47 are located at a low position, and hence setting change work and maintenance work can be efficiently performed without requiring an unnatural posture of the worker.

In the electrical unit mounting structure configured as described above, the control panel 9, and the like, need not be projectingly provided at the side of the support post 3 or at the sheet case 4 as in the conventional structure. Also, the control panel 9, and the like, can be collected in a simple and less expensive structure in the direction of the support post so as to be installed in the support post space 41. Further, since the support post space 41 is formed in the vertical direction which is the direction of the support post, the control panel 9 corresponding to the type of the sheet shutter 1 having, for example, a different size, and the like, can be installed by selecting a desired height. Further, the operating section 9*a* described below, a tool, an operation manual, and the like, can be stored in a free space. Thus, the support post space 41 can be used as a convenient multi-purpose space.

Further, one end of the electrical base 42 of the control panel 9 is rotatably provided in the support post space 41, and the other end of the electrical base 42 is attached so as to be rotatably extracted in the front and rear direction. Thus, an efficiently collected compact wiring structure can be formed in such a manner that the electrical unit is arranged at the rotation fulcrum side of small amount of movement, so as to be connected to the motor 7 by the electric wire 58 of a short length. Further, in the wiring structure, the bending of the electric wire 58 and the various cords, which are arranged at the side of a small amount of movement, can be reduced when the control panel 9 is rotated to be taken out or accommodated. Thus, the wiring structure has a feature that a trouble can be prevented from occurring in the wiring.

Next, the operating section 9*a* will be described with reference to FIG. 1 to FIG. 3, FIG. 7 and FIG. 8.

The operating section 9*a* is configured by installing, in each of the support posts 3, a switch panel (operation face plate) 61 in an exposed state at a portion having a height allowing an operation in the stand-up state. Specifically, the operating section 9*a* is configured by a switch attaching plate 62 having a channel-shaped plan cross-section which is recessed from the support post opening section 3*h* to the side of the storage space 41 so as to be able to be attached on the side of the opening edge 3*j* for attaching the cover, the switch panel 61 detachably attached to nuts 63 having washers and vertically fixed to the inner side of the switch attaching plate 62, and screws 64, and the like, for attaching the switch panel 61 to the nut 63 and the opening edge 3*j*.

The switch panel 61 is formed to have a length corresponding to the switch attaching plate 62, and is formed to have a width which is enough to cover the support post opening section 3*h* and to allow the switch panel 61 to be fitted in the surface step section of the opening edges 3*j* on both sides of the support post opening section 3*h*. A plurality of operation switches 66 for performing operations to start and stop the normal/reverse rotation of the motor 7 are vertically attached to the switch attaching plate 62, and each of the operation switches 66 is provided so as to be on-off operable by being pressed through the operation hole bored in the switch panel 61.

Note that a monitor 67 which displays operation states is provided in the switch panel 61 of the right operating section 9*a*. Further, the wiring harness of each of the operation switches 66, and the like, provided in the switch panel 61 is connected to the control panel 9 through the wiring space 3*g*.

The operating section 9*a* configured as described above is attached in such a manner that the nuts 63 are fastened to the upper and lower ends of the switch attaching plate 62 by countersunk screws 68, and that each of the leg portions of the switch attaching plate 62 having the U-shaped cross-section is then fitted to the groove section 3*k* of the opening edge 3*j*. After the switch panel 61 is fitted to the opening edges 3*j* from the front side, the screws 64 are inserted and fastened to the nuts 63. The switch panel 61 is drawn to the side of the switch attaching plate 62 by fastening the screw 64 so that each of the opening edges 3*j*, corresponding to both sides of the switch panel 61 and the switch attaching plate 62, is strongly sandwiched between the switch panel 61 and the switch attaching plate 62. Thus, the operating section 9*a* can be easily attached to the support post 3. In other words, the operating section 9*a* is detachably fixed to the support post 3 in such a manner that the pair of opening edges 3*j* and 3*j* are sandwiched between the switch panel 61 and the switch attaching plate 62, and that the switch panel 61 and the switch attaching plate 62 are fastened to each other.

Further, after the operating section 9*a* is attached, the support post 3 is closed by respectively fitting, to the support post opening sections 3*h* formed above and below the operating section 9*a*, the lid covers 15 respectively cut to the length of the opening sections. Thereby, the support post 3 can be finished in good appearance by closing the whole support post opening sections 3*h*. On the other hand, in the case where the operating section 9*a* is disassembled, when the screws 64 are loosened to remove the switch panel 61, the connection between the switch attaching plate 62 and the opening edge 3*j* is released, and thereby the operating section 9*a* can be freely handled in the support post space 41.

Thereby, the switch attaching plate 62 can be detached from the groove section 3*k* so as to be inclined as shown by the dotted line in FIG. 8, and hence can be taken out from the support post opening section 3*h*. Therefore, the operating section 9*a* configured as described above has such a feature that, since the switch attaching plate 62 can be detachably attached by using the inner side of the opening edge 3*j* for attaching the cover, the position at which the operating section 9*a* is attached can be freely selected in the direction of the support post and hence the operating section 9*a* can be attached at a suitable position.

Next, there will be described the operation and the use mode of the sheet shutter 1 including the sheet guide configured as described above.

The sheet shutter 1 performs rotation control so that the rotation of the sheet drum 5 is stopped when the sheet 2 is wound around the sheet drum 5 and thereby the stopper 33 reaches an uppermost lift position set just below the position at which the stopper 33 is brought into contact with the sheet stopper piece 32 of the sheet return guide 17. The state where the grounding section 12 is stopped at the position above the return groove 31 of the sheet return guide 17, which position corresponds to the uppermost lift position of the stopper 33, is the standby attitude for the next lowering operation. When the sheet 2 is unwound by the rotation of the sheet drum 5 in the unwinding direction, each of the guide projections 10 provided at both ends of the sheet 2 is slid downward by being guided by the inner rail 16 of the support post 3. Then, when the sheet drum 5 is automatically stopped at the position at which the grounding section 12 is grounded to the installation surface, the frontage is closed in the state where the sheet 2 is stretched in the width (lateral) direction and prevented from slackening.

In the sheet shutter 1, when the sheet 2 is held in the closed state or is being lifted or lowered, and when the guide projection 10 is about to come off from the engagement guide 21 by the sheet 2 being pressed by a strong wind, the coming-off of the guide projection 10 is prevented by the engagement force of the engagement guide 21, and at this time, the inner rail 16 is slid and moved inward against the pulling force (elasticity) of the elastic film member 26.

Further, when the wind pressure is reduced, the inner rail 16 is returned to the original sheet stretching attitude according to the elasticity of the elastic film member 26. Therefore, the inner rail 16 can stretch and support the sheet 2 while buffering the wind pressure in correspondence with the change of the wind, and allows the opening and closing operation to be smoothly performed while preventing the coming-off of the sheet due to the wind.

Further, when a passing object, such as a vehicle, collides with the sheet 2, and when the sheet 2 thereby receives strong external force in the front or rear direction so that the inner rail 16 reaches the slide limit and the sheet 2 is more strongly pressed as shown in FIG. 5, the guide projection 10 is inclined in the pressing direction and acts to forcibly widen the space between the holding bodies 23 and 23. Thereby, the guide projection 10 comes off from the engagement guide 21 by widening the sheet groove 23*b*, so as to be detached from the inner rail 16. As a result, the sheet 2 loses the support by the support post 3 to become free. Therefore, the sheet 2 can be prevented from being damaged by avoiding the pressing force exceeding the endurance limit from being applied to the sheet 2, and the load exceeding the endurance limit can also be prevented from being applied to the inner rail 16, the associated member fixed to the inner rail 16, and the like.

The sheet 2 detached from the inner rail 16 as described above is returned to the original state by the winding rotation of the sheet drum 5. At this time, however, the sheet 2 is lifted while the sheet 2 is freely deflected in the space between the left and right support posts 3, and the position of the guide projection 10 is freely changed in the front-and-rear and left-and-right directions. Further, when the sheet 2 is wound and lifted, the detached portion of the sheet 2 is automatically drawn into the return groove 31 of the sheet return guide 17 from one of the (front or rear) groove openings on the detached side of the sheet 2, and the sheet 2 is wound around the sheet drum 5 while the deflection of the sheet 2 is corrected when both sides of the sheet 2 on the side of the sheet drum 5 pass through the sheet grooves 23*b* above the return grooves 31.

Thereby, each side of the sheet 2 is automatically returned into the engagement guide 21 and then the sheet 2 is held in the lowering standby attitude at the uppermost lift position at which the grounding section 12 is stopped above the return groove 31 of the sheet return guide 17. Thus, the sheet 2 can be again lowered by the unwinding rotation of the sheet drum 5.

Further, in the case where, when the sheet 2 is lifted or lowered, one of the stoppers 33 is strongly brought into contact with the sheet stopper piece 32 so as to be pulled by the motor while being subjected to the resistance to regulate the lifting, and where one side of the sheet 2 is thereby strongly pulled, the upper side of the sheet return guide 17 and the inner rail 16 on the one side, as a whole, is rocked around the lower side as a fulcrum so as to be inclined against the elasticity of the elastic film member 26. At this time, the elastic film member 26 disperses the load in the pulling direction by the elasticity thereof while being compressed and deformed in the support post direction proportionally to the amount of displacement due to the inclination. Thus, the cushioning property against the inward rocking of the sheet return guide 17 and the inner rail 16 can be enhanced.

When the left and right direction movement of the inner rail 16 is repeated, the elastic film member 26, which is installed so that the inner corner section 27*a* and the outer corner section 28*a* of the elastic film section 29 are respectively positioned at the groove corner section 14*f* and the guide corner section 19*a* in the groove space section 14*e*, pulls the inner rail 16 outward against the inward pulling force which moves the inner rail 16 inward and which is caused by a large lifting load or pressing load received by the sheet 2. That is, the elastic film section 29 having the plurality of bending sections 29*a* within the film width is compressed in a folded state like bellows against its elasticity and counters the inward pulling force by pulling the inner rail 16 outward while expanding according to the reduction of the load. Further, since the elastic film section 29 is compressed into the bellows shape by being bent, the elastic film section 29 presses the inner rail 16 by uniform elastic force corresponding to the movement stroke, so as to allow the inner rail 16 to be smoothly moved in the left and right direction.

At this time, even when the elastic film section 29 is compressed by a large inward movement of the inner rail 16, since the elastic film section 29 is provided by being stretched in the diagonal direction of the groove space section 14*e*, space portions allowing sufficient deflections are formed at the front and rear sides of the elastic film section 29 in the groove space section 14*e*, so that the bending section 29*a* is prevented from being brought into contact with the side wall 14*a* and thereby the wear of the elastic film section 29 is suppressed. Further, the elastic film section 29 collectively applies the compressive force to the groove corner section 14*f* and the guide corner section 19*a*, and hence each of the corner sections regulates the positional deviation of the elastic film member 26.

Therefore, the elastic film member 26 acts to efficiently exhibit the pulling force even in long-term use.

Further, the elastic film member 26 without water permeability partitions the groove space section 14*e* into the groove inner side and the groove outer side which are respectively located on the front and rear sides of the elastic film section 29. Thus, even when washing water, rain water, dust, and the like, enter the groove outer side, the elastic film member 26 can prevent these from entering the groove inner side.

Further, since the elastic film member 26 made of a rubber material has a smooth surface, high water repellency, and a quick drying property, even when the elastic film member 26 is frequently subjected to spray washing by tap water, and even when the elastic film member 26 receives rain water combined with strong wind, the elastic film member 26 can surely regulate the entering of the water due to the pressure of the water. Further, the elastic film member 26 prevents dust and water from being attached thereto, and hence the sheet shutter 1 can be made excellent in durability and maintenance workability.

At this time, the surface side of the elastic film section 29, which is provided to be stretched in the diagonal direction of the groove space section 14*e*, is arranged to face the open end side of the rail groove 14*c* and hence can directly receive tap water, so as to allow stuck matters to be efficiently washed out and so as to surely prevent water from entering the deep portion of the groove. Therefore, the sheet shutter 1 has a feature that it can be suitably used in a food factory in which sterilization and washing by water need to be performed daily.

Note that, in a form of the sheet shutter 1 which can be used for various applications without being limited to the shape of the illustrated example, the elastic film member 26 can be configured by, for example, an elastic film section 29 having an elastic thin plate band without the inner seat surface 27 and the outer seat surface 28. In this case, it is preferred that a contact section, which is brought into engaging contact with each of the groove corner section 14*f* and the guide corner section 19*a*, is formed at each of the film width ends of the elastic film section 29.

Figure 17:
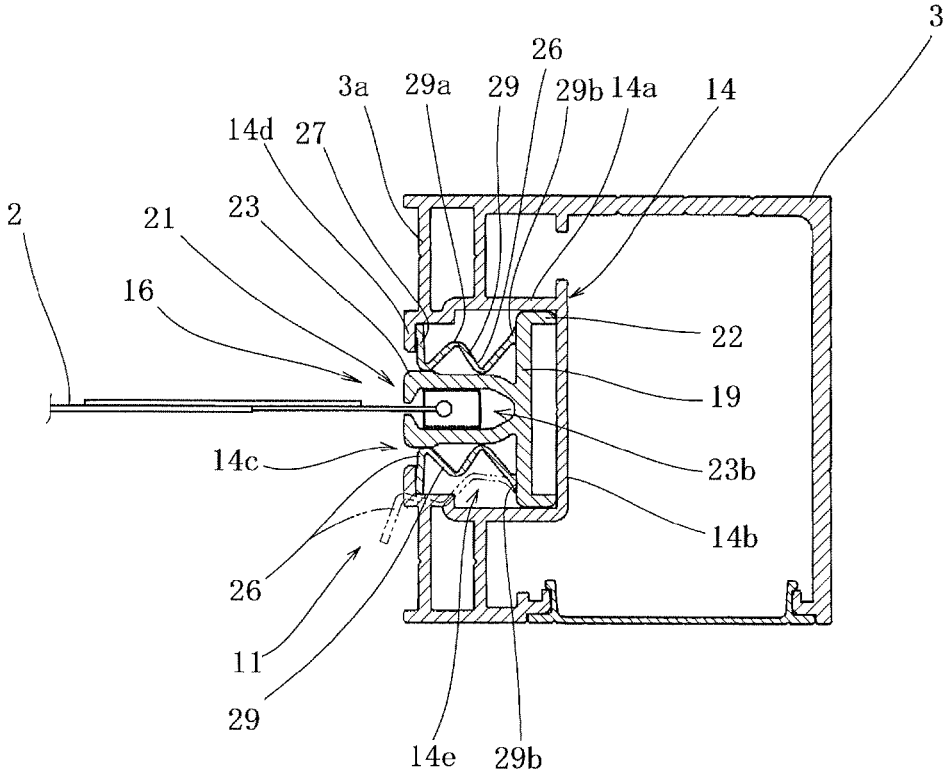
FIG. 17 is a sectional view showing another embodiment of a sheet stretching mechanism in which the elastic film member is integrated with the inner rail.

Further, the elastic film member 26 can also be inserted and set in the state where the insertion direction of the elastic film member 26 into the groove space section 14*e* is reversed to the direction as shown in FIG. 17. That is, in this case, the inner corner section 27*a* is set close to the side of the holding body 23 of the engagement guide 21, and the outer corner section 28*a* is set away from the guide corner section 19*a*.

Further, in each of the front and rear sides of the engagement guide 21 of the inner rail 16, the outer seat surface 28 of the elastic film member 26 can also be bonded beforehand to the rail base 19. In this case, packing and transportation can be efficiently performed in the state where the pair of front and rear elastic film members 26 are integrated with the inner rail 16. Further, when the elastic film member 26 is attached to the outer rail 14, the elastic film member 26 can be easily inserted into the outer rail 14 from one side of the outer rail 14 in the state which the elastic film member 26 bonded to each of the front and rear sides of the engagement guide 21 is compressed. Thus, the assembly cost can be reduced.

Figure 16:
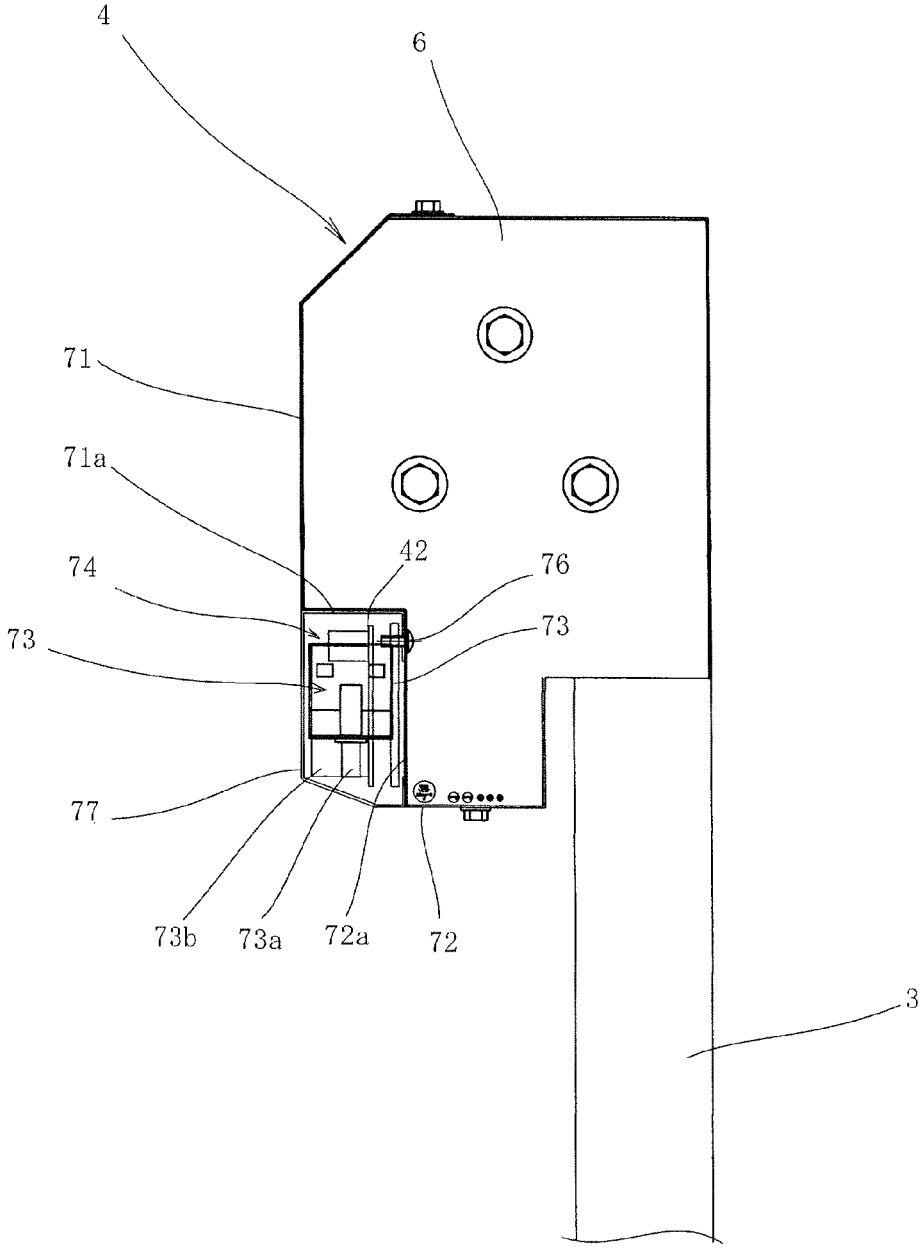
FIG. 16 is a side view showing another embodiment of the sheet case.

Next, another embodiment of the sheet case 4 in the case where the electrical unit is attached to the sheet case 4 will be described with reference to FIG. 16.

In the sheet case 4, a corner portion of a front surface wall 71 and a bottom wall 72 is recessed inward in a cut-out shape, so that a storage space 74 in which an electrical unit 73 can be installed is formed in the whole length direction of the sheet case 4. That is, the storage space 74 is formed by a lateral surface section 71*a* formed by bending inward the lower side of the front surface wall 71, and a vertical surface section 72*a* formed by bending upward the front side of the bottom wall 72.

On the other hand, the electrical unit 73 is configured by attaching the base 43 having various electrical components to the electrical base 42 similarly to the control panel 9. The electrical unit 73 can be detachably installed in the storage space 74 by attaching the electrical base 42 to the vertical surface section 72*a* by screws 76. Further, it is preferred that the electrical unit 73 is attached in the storage space 74 in the state where, when the electrical unit 73 is attached, at least the outer side surface of the electrical unit 73 is covered beforehand by a transparent or translucent electrical cover 77 made of a synthetic resin material.

The electrical cover 77 of the illustrated example is configured such that the electrical unit 73 can be inserted into the electrical cover 77 from the rear surface side of the electrical cover 77, and such that, in this state, the cover rear surface wall is sandwiched between the electrical base 42 and the vertical surface section 72*a*, so as to be attached by being fastened by the screws 76. Thereby, the electrical cover 77 can be attached without projecting from the external shape of the sheet case 4, in the state of covering the whole surfaces of the front surface, the bottom surface, and the side surface of the electrical unit 73 in the storage space 74. Further, the appearance design properties of the sheet shutter 1 can be improved by the installation of the electrical cover 77 made of the synthetic resin material.

Note that, when the control panel 9 is installed in the support post 3, the detection section 9*b*, a light 73*a* for illuminating the installation surface, a display apparatus 73*b* for displaying various display contents, and the like, can be provided in the electrical cover 77 as required. Further, in the case where the electrical unit 73 covered by the electrical cover 77 is installed, when the lower side of the sheet case 4 is formed in a downward swelled shape as compared with the sheet case shown in FIG. 2, the storage space 74 having a sufficient size can be provided, and hence the control panel 9 configured as described above can be easily installed in the storage space 74.

Next, another embodiment of the elastic film member 26 will be described with reference to FIG. 17.

The inner rail 16 and the elastic film member 26 can be manufactured in the state where they are integrated with each other. Another embodiment of the sheet stretching mechanism configured by the inner rail 16 and the elastic film member 26 in this case will be described below. Note that the description of the same configuration and operation as those of the above described embodiment is omitted.

Each of the elastic film members 26 arranged at the front and rear portions of the engagement guide 21 is configured such that the base 29*b* of the elastic film section 29 is integrally bonded to a portion near each of the front and rear ends of the inner surface of the rail base 19. Further, in the elastic film section 29, the plurality of bending sections 29*a* which can be freely folded in a bellows shape within the film width, and the inner seat surface 27 located at the film end are formed in series along the direction of the inner rail. In other words, the end portion of the elastic film section 29 on the side of the rail base 19 is formed integrally with the rail base 19 by bonding different materials to each other.

That is, in the unloaded state, the elastic film member 26 formed integrally with the rail base 19 of the inner rail 16 is in the expanded state where the folding of each of the bending section 29*a* is released to be expanded as shown by the dotted line in FIG. 17. Then, each of the elastic film members 26 is folded by being compressed at each side of the engagement guide 21, so as to be inserted into the outer rail 14 together with the inner rail 16. Thereby, each of the front and rear elastic film members 26 exhibits the function of pulling the sheet 2 by pressing the rail base 19 toward the bottom wall 14*b* in the state where the inner seat surface 27 is brought into contact with the inner groove wall 14*d* in the outer rail 14.

Further, in the elastic film member 26 configured integrally with the inner rail 16, the process of bonding the outer seat surface 28 of the elastic film section 29 to the rail base 19 can be omitted, and hence the kind of components, the manufacturing cost, the transportation cost, and the like, can be reduced. Further, as shown in the illustrated example, even when the base 29*b* is arranged near each of the front and rear ends of the rail base 19, since the elastic film section 29 is formed integrally with the rail base 19, no positional deviation of the elastic film section 29 is caused. Therefore, the elastic film section 29 promotes smooth movement of the inner rail 16 and maintains the function of pulling the sheet 2 for a long period.

Note that the inner rail 16 and the elastic film member 26 can be integrally manufactured easily by an extrusion or drawing process using an integral molding method of different materials, which is based on known means and in which a hard synthetic resin material and a soft synthetic resin material are simultaneously supplied to main portions of one mold, respectively. Note that, in the process, the hard synthetic resin material is supplied to the mold portion on the side of the inner rail 16, and the soft synthetic resin material is supplied to the mold portion on the side of the elastic film member 26, so that the material bonding between both the synthetic resin materials is stably performed at the joining portion between the base 29*b* of the elastic film section 29 and the rail base 19.

Note that, in the case where the inner seat surface 27 and the outer seat surface 28 of the elastic film member 26 are both formed, the elastic film section 29 is formed between the guide corner section 19*a* and the groove corner section 14*f* in the oblique direction in sectional plan view in the example shown in FIG. 4, and the like. However, the elastic film member 26 may also be provided in the groove space section 14*e* by reversing the front and rear sides of the elastic film member 26. Specifically, one end portion of the elastic film section 29 is located on the side opposite to the guide corner section 19*a* in the front and read direction so as to sandwich the groove space section 14*e* with the guide corner section 19*a* in sectional plan view, while the other end portion of the elastic film section 29 is located on the side opposite to the groove corner section 14*f* in the front and read direction so as to sandwich the groove space section 14*e* with the groove corner section 14*f* in sectional plan view.

What is claimed is:

1. A sheet shutter which includes a pair of vertically directed left and right support posts, and a sheet case provided between the upper end portions of the left and right support posts, and is configured such that outer rails respectively having vertically directed rail grooves whose left and right inner sides in sectional plan view are respectively opened are respectively provided in the mutually facing surfaces of the support posts, such that at least a part of an inner rail is accommodated in the rail groove of each of the left and right outer rails so as to be left and right movably supported, such that a vertically directed engagement guide which, in the state where both the left and right end sides of a sheet unwounded from the inside of the sheet case are regulated from being moved in the left and right direction, guides the lifting and lowering of each of the left and right end sides of the sheet is formed in each of the left and right inner rails, such that an urging member which elastically urges the inner rail toward the bottom side of the rail groove is provided in a gap space formed between the inner rail and each or one of groove side surfaces which are both the front and rear surfaces of the rail groove accommodating the inner rail, and such that the sheet is pulled toward both the left and right sides by the urging member, wherein the urging member includes an elastic sheet section which partitions the gap space into front and rear portions, wherein the inner rail is formed in the vertical direction over the whole length in the length direction of the rail groove of the outer rail, wherein the inner rail is in surface contact with front and rear side walls of the outer rail, and wherein the inner rail is elastically urged in the left and right outer side by an elastic curving deformation or an elastic bending deformation of the elastic sheet section.

2. The sheet shutter according to claim 1, wherein a rail base is integrally extended from the bottom surface side end portion of the rail groove of the inner rail in the front and rear direction toward the groove side surface, wherein an opposite wall extended in the front and rear direction from each of the open end sides of the rail groove of the outer rail is integrally provided so as to face the rail base, and wherein the elastic section is inserted between the rail base and the opposite wall.

3. The sheet shutter according to claim 2, wherein a guide corner section is formed by the rail base and the engagement guide extended from the rail base toward the left and right inner side, wherein a groove corner section is formed by the opposite wall and the groove side surface, and wherein the elastic sheet section is provided in the gap space by being brought into contact with the guide corner section and the groove corner section.

4. The sheet shutter according to claim 3, wherein a plate-shaped opening side contact section which is brought into surface contact with the opposite wall is integrally formed at an end portion of the elastic sheet section near the groove corner section.

5. The sheet shutter according to claim 4, wherein the opening side contact section is formed so as to close the gap space the open end side of the rail groove.

6. The sheet shutter according to claim 3, wherein the end portion of the elastic sheet section on the side of the rail base is formed integrally with the rail base.

7. The sheet shutter according to claim 3, wherein a plate-shaped bottom side contact section which is brought into surface contact with the rail base is integrally formed at the end portion of the elastic sheet section on the side of the guide corner section.

8. The sheet shutter according to claim 1, wherein an expanding and contracting section which is formed in a bellows shape by a plurality of foldable bending sections is provided in the elastic sheet section.

9. The sheet shutter according to claim 1, wherein the outer rail is formed integrally with an inner side wall forming each of the left and right inner ends of the support posts and with an intermediate wall formed in the left and right middle portion in the support post so that the inner side wall and the intermediate wall are connected to each other by the outer rail.

10. The sheet shutter according to claim 2, wherein an expanding and contracting section which is formed in a bellows shape by a plurality of foldable bending sections is provided in the elastic sheet section.

11. The sheet shutter according to claim 3, wherein an expanding and contracting section which is formed in a bellows shape by a plurality of foldable bending sections is provided in the elastic sheet section.

12. The sheet shutter according to claim 4, wherein an expanding and contracting section which is formed in a bellows shape by a plurality of foldable bending sections is provided in the elastic sheet section.

13. The sheet shutter according to claim 5, wherein an expanding and contracting section which is formed in a bellows shape by a plurality of foldable bending sections is provided in the elastic sheet section.

14. The sheet shutter according to claim 6, wherein an expanding and contracting section which is formed in a bellows shape by a plurality of foldable bending sections is provided in the elastic sheet section.

15. The sheet shutter according to claim 7, wherein expanding and contracting section which is formed in a bellows shape by a plurality of foldable bending sections is provided in the elastic sheet section.

16. The sheet shutter according to claim 2, wherein the outer rail is formed integrally with an inner side wall forming each of the left and right inner ends of the support posts and with an intermediate wall formed in the left and right middle portion in the support post so that the inner side wall and the intermediate wall are connected to each other by the outer rail.

17. The sheet shutter according, to claim 3, wherein the outer rail is formed integrally with an inner side wall forming each of the left and right inner ends of the support posts and with an intermediate wall formed in the left and right middle portion in the support post so that the inner side wall and the intermediate wall are connected to each other by the outer rail.

18. The sheet shutter according to claim 4, wherein the outer rail is formed integrally with an inner side wall forming each of the left and right inner ends of the support posts and with an intermediate wall formed in the left and right middle portion in the support post so that the inner side wa1l and the intermediate wall are connected to each other by the outer rail.

19. The sheet shutter according to claim 5, wherein the outer rail is formed integrally with an inner side wall formimg each of the left and right inner ends of the support posts and with an intermediate wall formed in the left and right middle portion in the support post so that the inner side wall and the intermediate wall are connected to each other by the outer rail.

20. The sheet shutter according to claim 6, wherein the outer rail is formed integrally with an inner side wall forming each of the left and right inner ends of the support posts and with an intermediate wall formed in the left and right middle portion in the support post so that the inner side wall and the intermediate wall are connected to each other by the outer rail.

21. The sheet shutter according to claim 7, wherein the outer rail is formed integrally with an inner side wall forming each of the left and right inner ends of the support posts and with an intermediate wall formed in the left and right middle portion in the support post so that the inner side wall and the intermediate wall are connected to each other by the outer rail.

22. The sheet shutter according to claim 8, wherein the outer rail is formed integrally with an inner side wall forming each of the left and right inner ends of the support posts and with an intermediate wall formed in the left and right middle portion in the support post so that the inner side wall and the intermediate wall are connected to each other by the outer rail.

* * * * *